US010655512B2

(12) United States Patent
Okada et al.

(10) Patent No.: US 10,655,512 B2
(45) Date of Patent: May 19, 2020

(54) INTERNAL COMBUSTION ENGINE OF SADDLE RIDING VEHICLE

(71) Applicant: HONDA MOTOR CO., LTD., Tokyo (JP)

(72) Inventors: Nozomi Okada, Wako (JP); Yosuke Hoi, Wako (JP); Toru Kisaichi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 189 days.

(21) Appl. No.: 15/914,681

(22) Filed: Mar. 7, 2018

(65) Prior Publication Data

US 2018/0283243 A1 Oct. 4, 2018

(30) Foreign Application Priority Data

Mar. 30, 2017 (JP) ..... 2017-069140

(51) Int. Cl.
*F01M 1/06* (2006.01)
*F01M 9/10* (2006.01)

(52) U.S. Cl.
CPC ..... *F01M 9/105* (2013.01); *F01M 9/102* (2013.01); *F01M 9/103* (2013.01); *F01M 2001/064* (2013.01)

(58) Field of Classification Search
CPC ..... F01M 9/105; F01M 9/103; F01M 9/102; F01M 2001/064
See application file for complete search history.

(56) References Cited

U.S. PATENT DOCUMENTS 7,115,009 B2 * 10/2006 Itoh ..... F01M 11/0004 440/88 R
2002/0157631 A1 10/2002 Kawamoto

FOREIGN PATENT DOCUMENTS

| | | | |
|---|---|---|---|
| JP | 9-79017 | A | 3/1997 |
| JP | 2001-173421 | A | 6/2001 |
| JP | 2002-122012 | A | 4/2002 |
| JP | 2003-254025 | A | 9/2003 |

* cited by examiner

*Primary Examiner* — Zelalem Eshete
(74) *Attorney, Agent, or Firm* — Birch, Stewart, Kolasch & Birch, LLP

(57) ABSTRACT

In a valve train of an internal combustion engine, an input sprocket mounting portion is provided on one end of an exhaust camshaft, and a valve operating cam portion is formed on the other end of the camshaft. A decompression shaft of a decompression device is inserted in a decompression shaft hole, which is formed from the input sprocket mounting portion toward the valve operating cam portion. The decompression shaft hole is formed at a position offset from an axis of the camshaft. A camshaft inner oil passage is formed in the camshaft to extend from one end toward the other end of the camshaft in parallel arrangement to the decompression shaft hole to supply lubricant from the bearing journal portion to the bearing journal portion. The above arrangement makes it possible to supply a sufficient amount of lubricant oil to slide portions of the valve train of a saddle riding vehicle.

6 Claims, 16 Drawing Sheets

INTERNAL COMBUSTION ENGINE OF SADDLE RIDING VEHICLE

TECHNICAL FIELD

The present invention relates to an internal combustion engine of a saddle riding vehicle in which oil can be sufficiently supplied to slide portions of a valve train or valve operating system of the engine.

BACKGROUND ART

Conventionally, as one example of internal combustion engines of a saddle riding vehicle, including a decompression device of a valve train or valve operating system, there has been known an internal combustion engine disclosed in Patent Document 1 below. In this internal combustion engine, a decompression shaft or operating shaft which is rotated under a centrifugal force of a decompression weight of the decompression device is fitted in a decompression shaft hole formed in an exhaust camshaft of the valve train. The decompression shaft hole is positioned on an axis of the exhaust camshaft. In such an internal combustion engine, if it is attempted to form an oil supply passage in the exhaust camshaft for supplying oil to the cam surfaces of intake/exhaust camshafts and to journal portions thereof, it is difficult to additionally form such an oil supply passage, since the decompression shaft is positioned on the axis of the exhaust camshaft. Therefore, a portion of the decompression shaft hole must be used as an oil supply passage for supplying oil to the respective portions of the valve train, and hence it is difficult to supply a sufficient amount of oil to the respective portions of the valve train.

PRIOR ART

Patent Document

[Patent Document 1] JP 3 705 726 B

SUMMARY OF INVENTION

Technical Problem

The present invention has been made to overcome the above problem, and it is an object of the present invention to provide an internal combustion engine of a saddle riding vehicle which can supply a sufficient amount of oil to respective sliding portions of a valve train.

Solution to Problem

To attain the above object, the present invention provides an internal combustion engine of a saddle riding vehicle, wherein the engine has a valve train in which an exhaust camshaft rotatably mounted on a cylinder head forms a portion of an oil supply passage to the valve train, the exhaust camshaft having a bearing journal portion on one side thereof and another bearing journal portion on another side, and the valve train includes a centrifugal decompression device making use of rotation of the exhaust camshaft, wherein:

the valve train includes one bearing journal portion formed on one end of the exhaust camshaft and supported by the cylinder head, and another bearing journal portion on another end of the camshaft; an input sprocket mounting portion for mounting thereon an input sprocket for driving the camshaft is formed on the one end of the camshaft, while a valve operating cam portion is formed on the other end of the camshaft; a decompression shaft hole receiving rotatably therein a decompression shaft of the decompression device is formed in the camshaft from the input sprocket mounting portion toward the valve operating cam portion; the decompression shaft hole is formed at a position offset from an axis of the camshaft; and a camshaft inner oil passage is formed in the camshaft to supply a lubricant to the bearing journal portion on the one side and to the bearing journal portion on the other side, the camshaft inner oil passage extending from the one end to the other end of the camshaft in parallel arrangement to the decompression shaft hole.

With such a configuration, the decompression shaft hole in the camshaft is formed at a position offset from the axis of the camshaft, and hence the camshaft inner oil passage, which extends from one end toward the other end of the camshaft in parallel arrangement to the decompression shaft hole and which supplies lubricant oil from the bearing journal portion on one side to the bearing journal portion on the other side, can be properly formed in the camshaft. Accordingly, lubricant is supplied from the bearing journal portion on one side to the bearing journal portion on the other side using the additional camshaft inner oil passage without using the decompression shaft hole as an oil passage. It is thus possible to supply a sufficient amount of lubricant oil to respective ones of slide portions of the valve train.

In a preferred form of the invention, a decompression weight swing restricting portion for restricting rotation of a decompression weight integrally provided on the decompression shaft is disposed on one end of the camshaft at a position offset from the axis of the camshaft; and a decompression shaft removal preventing threaded portion is formed in the decompression weight swing restricting portion at a position parallel to the decompression shaft hole and offset from the axis of the camshaft, the decompression shaft removal preventing threaded portion being threadedly engaged with a bolt for preventing removal of the decompression shaft.

With such a configuration, the decompression weight swing restricting portion is disposed at a position offset from the axis of the camshaft, and the decompression shaft removal preventing threaded portion is formed on the decompression weight swing restricting portion. Accordingly, the decompression weight swing restricting portion and the decompression shaft removal preventing threaded portion can be arranged on the one end of the camshaft in a collective manner, and hence a large camshaft inner oil passage can be formed whereby it is possible to supply an increased amount of oil to the valve train.

In a preferred form of the invention, the camshaft has a first exhaust cam between the bearing journal portion on the one side and the bearing journal portion on the other side, and a second exhaust cam axially outside the bearing journal portion on the other side; the decompression device includes a decompression pin for movements to project from and retract into the second exhaust cam on the camshaft in connection with rotation of the decompression shaft; the decompression shaft hole extends axially to an area between the bearing journal portion on the one side and the bearing journal portion on the other side; and the camshaft inner oil passage is arranged on a side opposite to the decompression shaft removal preventing threaded portion with respect to the decompression pin, as viewed along the axis of the camshaft.

With such a configuration, the camshaft inner oil passage is formed to reach the exhaust cam on an axially far side without interfering with the decompression pin, and hence it is possible to supply a sufficient amount of oil also to the cam exhaust cam on an axially far side.

In a preferred form of the invention, the bearing journal portion on the one side has a diameter greater than a diameter of the bearing journal portion on the other side; and the decompression shaft removal preventing threaded portion is formed as an hole axially extending in the region of the bearing journal portion on the one side.

With such a configuration, by forming only the bearing journal portion on the one side where the decompression shaft removal preventing threaded portion is formed, with a greater diameter, it is possible to increase the size of only the bearing journal portion on the one side with a required minimum value, and hence the total weight of the camshaft can be reduced.

In a further preferred form of the invention, a center hole portion is formed in the decompression weight swing restricting portion of the camshaft, the center hole portion being a reference portion in machining the camshaft.

With such a configuration, while enhancing machinability of the camshaft by forming the center hole portion in the end portion thereof, a surface around the center hole portion can be used as a position restricting portion of the decompression weight.

In a still further preferred form of the invention, a tightening member accommodating hole is formed in a surface of the cylinder head, facing a cylinder head cover, the tightening member accommodating hole being for insertion and accommodation of a tightening member for fastening a crankcase and a cylinder body of the engine to each other; the bearing journal portion on the one side is rotatably supported by a head-side journal receiving portion disposed above the tightening member accommodating hole of the cylinder head and by a holder-side journal receiving portion formed on a camshaft holder positioned above the camshaft; and the camshaft inner oil passage is in communication with the tightening member accommodating hole of the cylinder head.

With such a configuration, worn-out powder and the like contained in oil supplied into the mounting member accommodating hole in the cylinder head can be held in the mounting member accommodating hole in the cylinder head. Accordingly, it is possible to supply oil from which impurities are removed, to the valve train.

In a preferred form of the invention, the camshaft has thereon a flange portion for restricting an axial thrust; and an oil passage leading into the camshaft is provided adjacent to the flange portion.

With such a configuration, bubbles generated around the flange portion can be readily discharged through the oil passage, and hence lubrication performance of the flange portion can be enhanced.

Advantageous Effects of Invention

According to the present invention, it is possible to supply a sufficient amount of oil to various places of the slide portions of the valve operating system or valve train.

DETAILED DESCRIPTION

Figure 1:
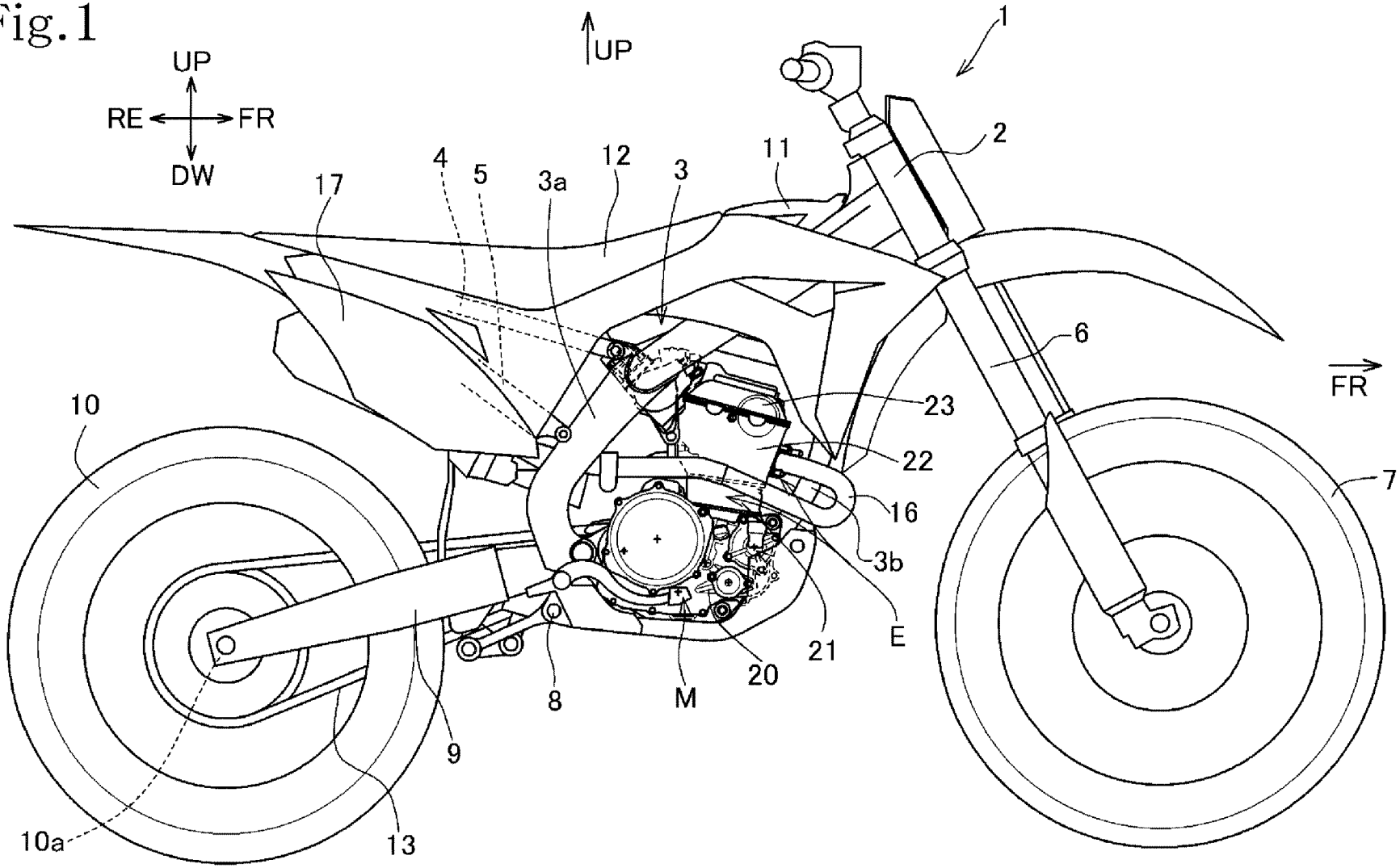
FIG. 1 is a right side view of a motorcycle on which an internal combustion engine of a saddle riding vehicle according to one embodiment of the present invention is mounted.

Hereinafter, an oil supply structure of a decompression device of an internal combustion engine of a saddle riding vehicle, according to an embodiment of the present invention, will be described with reference to the drawings.

In the description of this specification and claims, directions of frontward, rearward, leftward, rightward, upward, downward and so on are directions with respect to a vehicle on which is mounted an internal combustion engine provided with an oil filter mounting structure of an internal combustion engine according to this embodiment. In this embodiment, the vehicle is a saddle riding vehicle and, to be more specific, a two-wheeled motorcycle 1. Further, in the drawings, an arrow FR indicates a frontward direction of the vehicle, an arrow LH indicates a leftward direction of the vehicle, an arrow RH indicates a rightward direction of the vehicle, and an arrow UP indicates an upward direction of the vehicle, respectively. Further, small arrows in the drawings schematically show flow of oil in the embodiment of the invention.

An oil supply structure of a decompression device of the engine according to the embodiment of the present invention will be described with reference to the drawings including FIGS. 1 to 21. FIG. 1 is a right side view showing the motorcycle 1 on which is mounted an internal combustion engine E to which an oil supply structure of a decompression device according to the embodiment is applied.

The internal combustion engine E is a water-cooled, single cylinder, 4-valve, WOHC-type, 4-stroke cycle internal combustion engine mounted on the motorcycle 1. The internal combustion engine E includes a transmission M as an integral part thereof on a rear portion in a crankcase 20, whereby a so-called power unit is formed. The engine E is mounted on the motorcycle 1 in a state where a crankshaft 30 of the engine is directed in a vehicle width direction of the motorcycle 1, that is, in a lateral direction.

The motorcycle 1 includes a frame 3 directed in the longitudinal direction of the vehicle, and the frame 3 is fixed to a head pipe 2 mounted on a front end of the frame 3. A pair of left and right main frame members 3*a* extends rearward from the head pipe 2 in a slightly downward direction and, thereafter, the pair of left and right main frame members 3*a* is bent gradually downward and reaches a lower end of the frame 3. A down frame member 3*b* extends obliquely downward from the head pipe 2 at a steep angle, and the down frame member 3*b* is connected to lower ends of the main frame members 3*a*. A pair of left and right seat rails 4 extends rearward from intermediate portions of the main frame members 3*a*. A pair of left and right back stays 5 connects the center portions of the seat rails 4 and lower portions of the main frame members 3*a* to each other, respectively, whereby the left and right back stays 5 support the left and right seat rails 4. The head pipe 2 supports a front fork 6 which supports a front wheel 7 in a rotatable manner.

A pivot shaft 8 is mounted on a lower end portion of the main frame members 3*a*, and a rear fork 9, having a front end thereof swingably supported by the pivot shaft 8, extends rearward. A rear wheel 10 is rotatably supported on a rear end of the rear fork 9. A rear cushion not shown in the figure is interposed between the rear fork 9 and the main frame members 3*a*. A fuel tank 11 is disposed in a manner extending between front portions of the main frame members 3*a*, and a rider's seat 12 is disposed behind the fuel tank 11 and supported by the seat rails 4.

Figure 2:
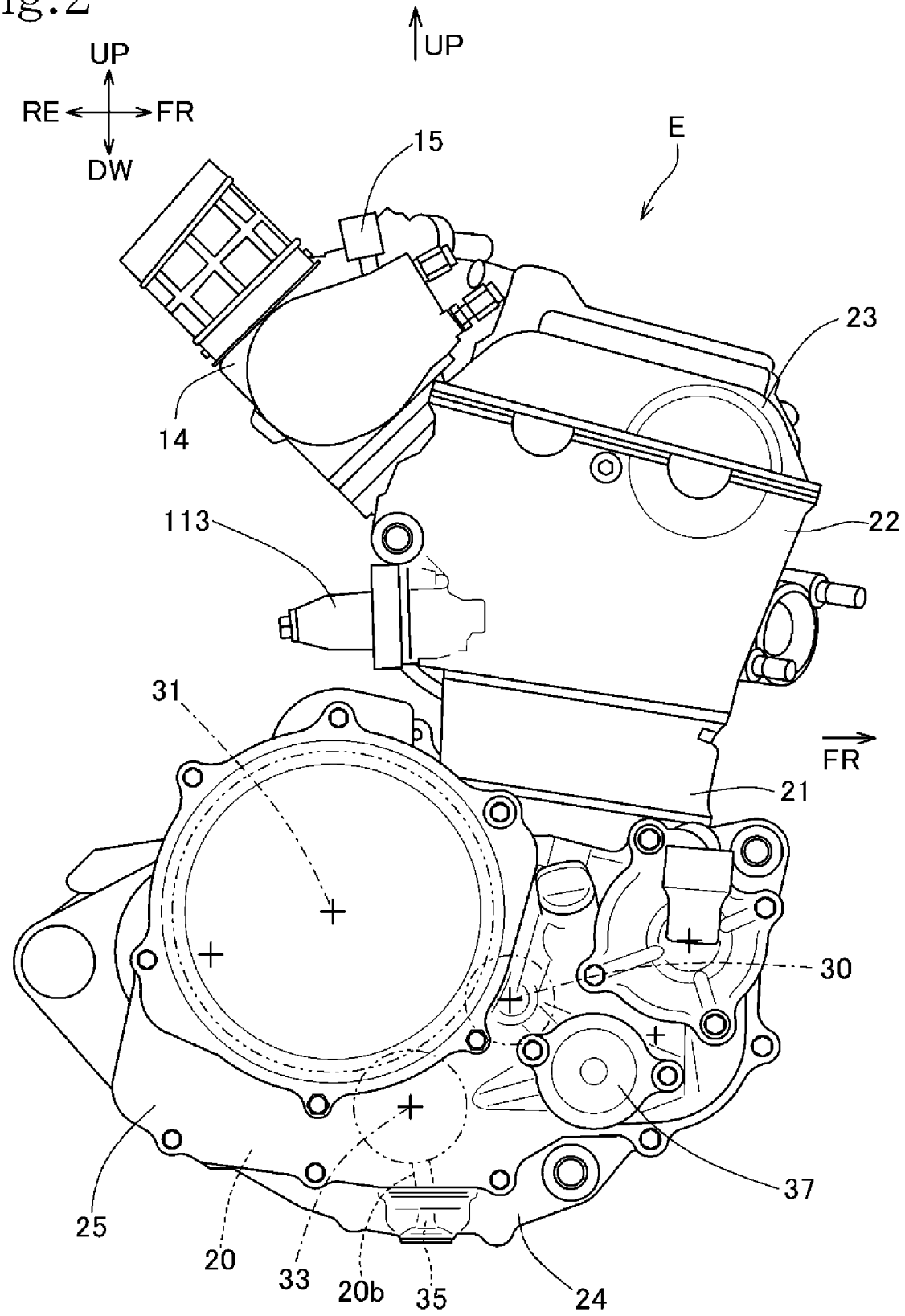
FIG. 2 is an enlarged right side view of the internal combustion engine shown in FIG. 1.

As shown in FIGS. 1 and 2, the internal combustion engine E is suspended from the main frame members 3*a* and the down frame member 3*b* in a standing attitude in which a cylinder axis is inclined slightly frontward in a position above the crankcase 20.

Figure 7:
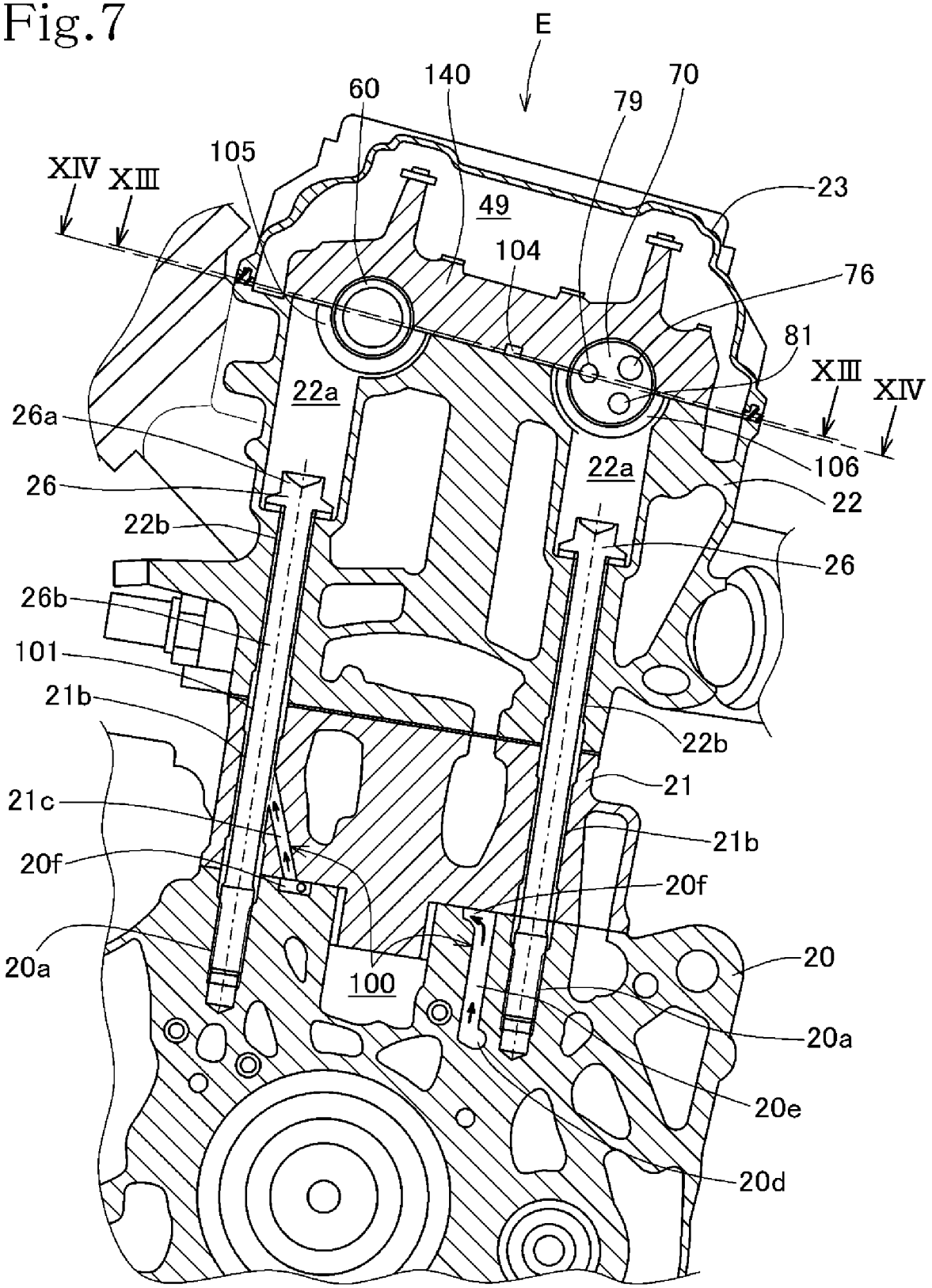
FIG. 7 is a longitudinal sectional view of the internal combustion engine taken along a line VII-VII in FIG. 13.

As shown in FIGS. 2 and 7, the internal combustion engine E has an integral body formed of a crankcase 20, a cylinder body 21, and a cylinder head 22. That is, the crankcase 20, the cylinder body 21, and the cylinder head 22 are sequentially stacked on each other. Stud bolts 26 are inserted first into bolt accommodating holes 22*a* formed in an upper surface of the cylinder head 22, respectively. The stud bolts 26 are then made to pass through bolt insertion holes 22*b* formed in the cylinder head 22 and through bolt insertion holes 21*b* formed in the cylinder body 21. The stud bolts 26 are finally screwed into bolt holes 20*a* formed in the crankcase 20. A cylinder head cover 23 is mounted on an upper portion of the cylinder head 22. Left and right sides of the crankcase 20 are covered by case covers 25 (FIG. 2). An oil pan 24 (FIG. 2) is mounted on a lower portion of the crankcase 20. A cylinder bore 21*a* (cylinder) is formed in the cylinder body 21 in a vertically penetrating manner, and the cylinder body 21 and the cylinder head 22 form a cylinder part of the engine.

Figure 3:
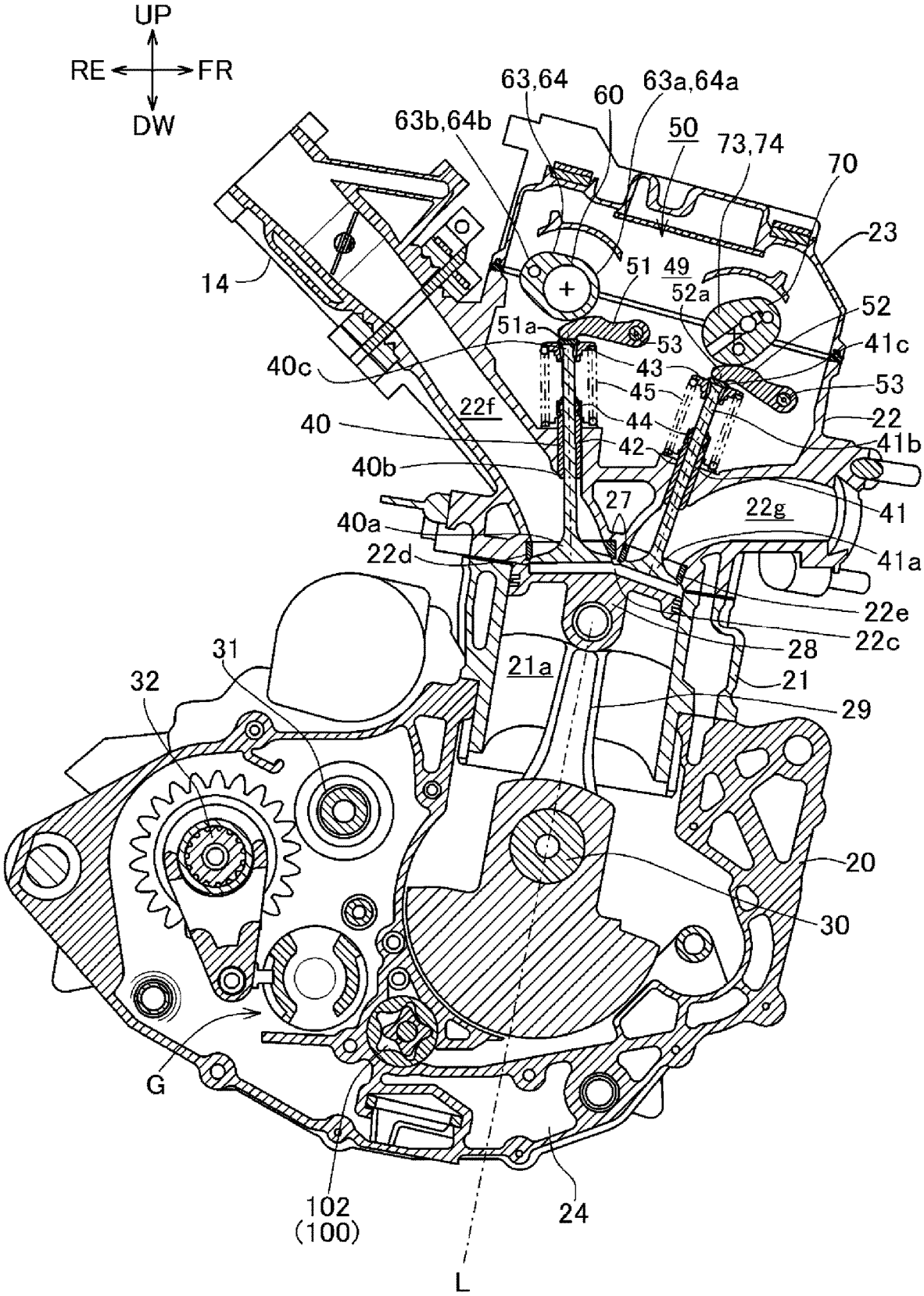
FIG. 3 is a longitudinal sectional view of the internal combustion engine taken along a line in FIG. 13.

As shown in FIG. 3, the cylinder body 21 is disposed with a cylinder axis L inclined with respect to a vertical direction. A piston 28 is slidably fitted in the cylinder bore 21*a* in a vertical direction, and a crank pin of the crankshaft 30 is connected to the piston 28 by way of a connecting rod 29. A combustion chamber 22*c* is formed in the cylinder head 22. A combustion energy in the combustion chamber 22*c* of the engine E is converted into kinetic energy of the piston 28. Due to such a conversion, the piston 28 is moved up and down so that the crankshaft 30 is driven in rotation by way of the connecting rod 29.

As illustrated in FIG. 3, the crankshaft 30 of the internal combustion engine E is rotatably supported on the crankcase 20. A shift gear device G is assembled between the main shaft 31 disposed behind the crankshaft 30 and a counter shaft 32 forming an output shaft. A chain 13 (FIG. 1) is extended between and wound around the counter shaft 32 and an axle 10*a* (FIG. 1) of the rear wheel 10 so that power of the crankshaft 30 is transmitted to the rear wheel 10.

As FIG. 3 shows, a pair of intake valve openings 22*d* and a pair of exhaust valve openings 22*e*, which open in an upper wall surface of the combustion chamber 22*c*, are formed in the cylinder head 22. An ignition plug hole (not shown in the figure) into which an ignition plug (not shown in the figure) is inserted opens such that the ignition plug hole is positioned at an approximately center between the intake valve openings 22*d* and the exhaust valve openings 22*e*. The intake valve openings 22*d* and the exhaust valve openings 22*e* are respectively communicated with an intake port 22*f* and an exhaust port 22*g* formed in the cylinder head 22.

As shown in FIG. 3, a throttle body 14 including a fuel injection valve 15 (FIG. 2), a connecting tube (not shown), and an air cleaner (not shown) are sequentially connected to the intake port 22*f*. Outside air sucked through the air cleaner is mixed with fuel injected from the fuel injection valve to form a fuel-air mixture. The fuel-air mixture is transferred to the combustion chamber 22*c* of the internal combustion engine E and is combusted. An exhaust gas from the engine is sent to a muffler 17 (FIG. 1) through an exhaust pipe 16 connected to the exhaust port 22*g* and is discharged to outside.

The internal combustion engine E includes: a pair of intake valves 40 which open and close to cause intake air from the intake ports 22*f* into the combustion chamber 22*c*, and a pair of exhaust valves 41 which open and close to cause exhaust gas from within the combustion chamber 22*c* to the exhaust ports 22*g*. The intake valves 40 open and close the intake valve openings 22*d*, and the exhaust valve 41 open and close the exhaust valve openings, respectively. Each of the intake valves 40 is formed of an umbrella portion 40*a* and a shaft portion 40*b*, and each of the exhaust valves 41 is formed of an umbrella portion 41*a* and a shaft portion 41*b*. The umbrella portions 40*a* and 41*a* are respectively valve elements which open and close the intake valve openings 22*d* and the exhaust valve openings 22*e* in each of which a valve seat 27 is press-fitted. The shaft portions 40*b* and 41*b* extend from the umbrella portions 40*a* and 41*a* to the outside of the combustion chamber 22*c*, respectively, and the shaft portions 40*b* and 41*b* are slidably fitted in valve guides 42 fitted in the cylinder head 22.

Shaft end portions 40*c* of the intake valves 40 and shaft end portions 41*c* of the exhaust valves 41 protrude upward from the valve guides 42 respectively, and the shaft end portions 40*c* and 41*c* are held by spring retainers 43 respectively. Coil-shaped valve springs 45 are mounted in a compressed state between the spring retainers 43 and spring receiving members 44 which are supported by the cylinder head 22 so as to face the corresponding spring retainer 43. The coil-shaped valve springs 45 surround peripheries of the shaft portions 40*b* of the intake valves 40 and the shaft portions 41*b* of the exhaust valves 41 respectively. The intake valves 40 and the exhaust valves 41 are constantly biased in valve closing directions by the valve springs 45.

A valve train 50 for opening and closing the intake valves 40 and the exhaust valves 41 is accommodated in a valve chamber 49 formed in an upper portion of the cylinder head 22 and defined by the cylinder head 22 and the cylinder head cover 23. In the valve train 50, an intake cam shaft 60, on which intake cams 63 and 64 are formed, and an exhaust cam shaft 70, on which exhaust cams 73 and 74 are formed, are rotatably supported by the cylinder head 22. Cam shaft holders 140 (see FIG. 5) are mounted on an upper surface of the cylinder head 22 using bolts 145. Along with the rotation of the intake cam shaft 60 and the exhaust cam shaft 70, the intake cams 63 and 64 and the exhaust cams 73 and 74 are rotated so that the intake valves 40 and the exhaust valves 41 are caused to be opened and closed.

Figure 4:
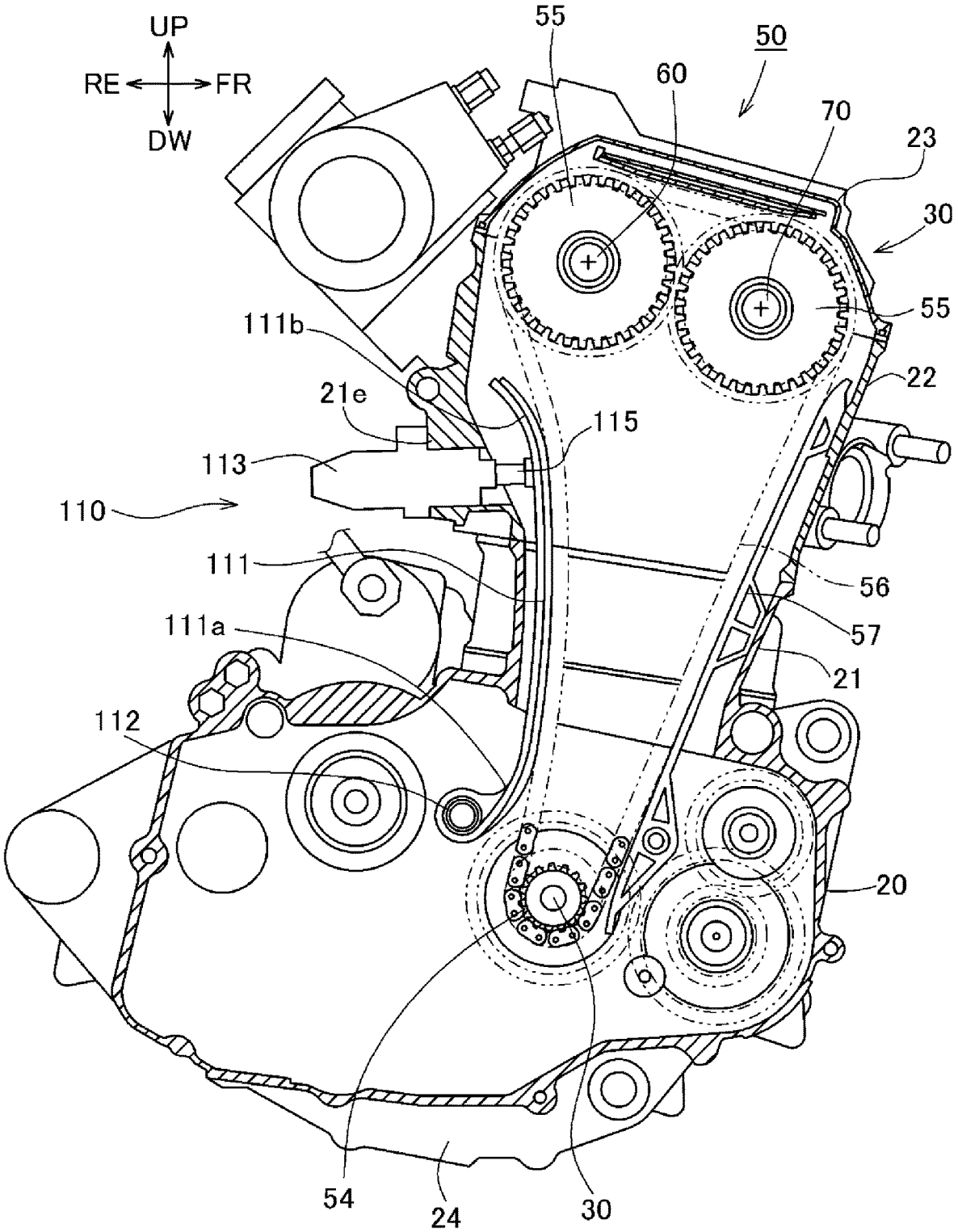
FIG. 4 is a longitudinal sectional view of the internal combustion engine taken along a line IV-IV in FIG. 13.
Figure 13:
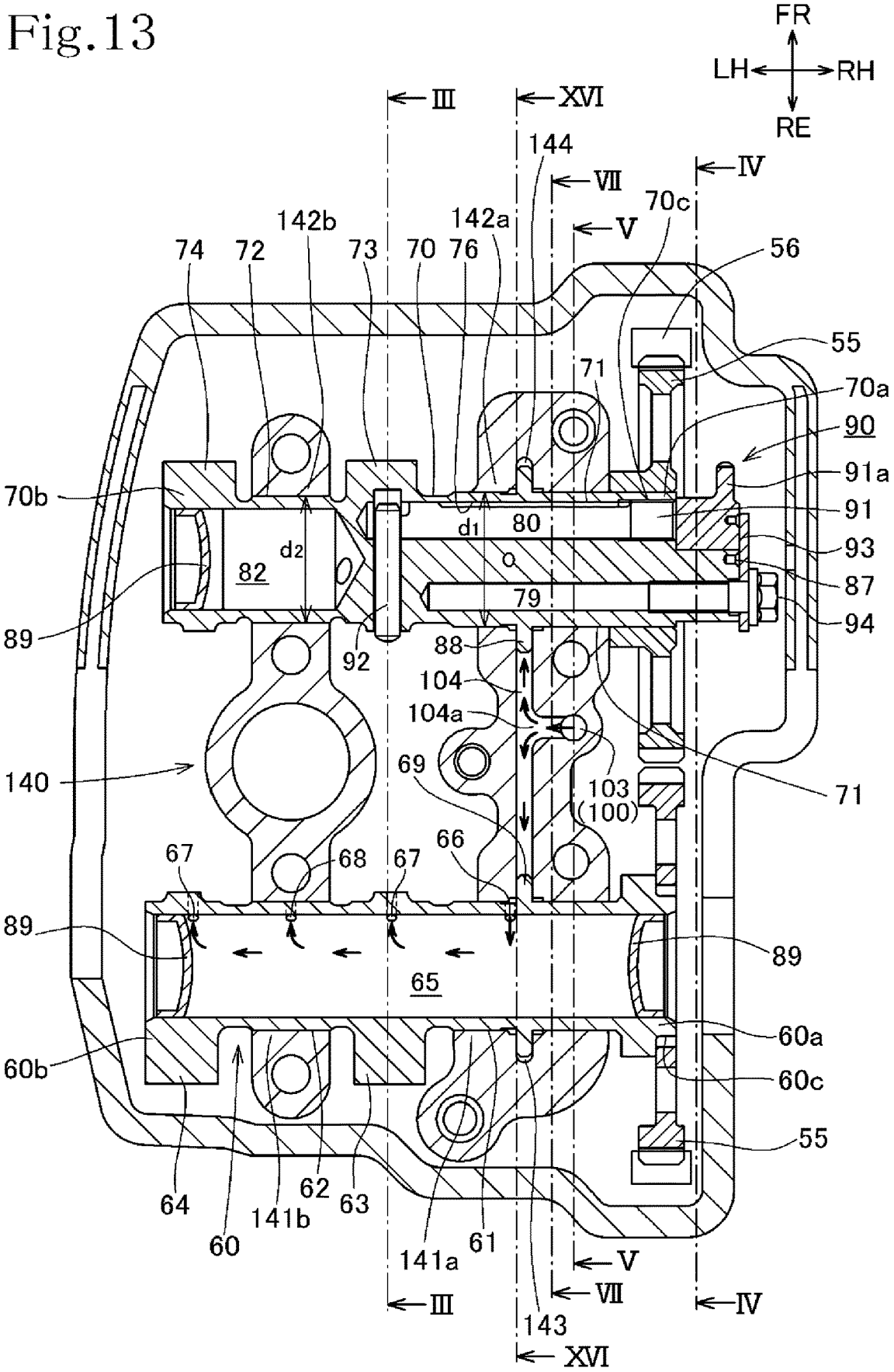
FIG. 13 is a sectional view of the internal combustion engine as viewed in a direction indicated by an arrow XIII-XIII in FIG. 7.

As shown in FIG. 13, input sprockets 55 are mounted on a right end of the intake cam shaft 60 and on a right end of the exhaust cam shaft 70, respectively, in an integrally rotatable manner. The pair of the input sprockets 55 are meshed with each other. As FIG. 4 shows, a cam chain 56 is extended between and wound around these input sprockets 55 and an output sprocket 54 on a right shaft portion of the crankshaft 30, so that the input sprockets 55 are rotatable with the crankshaft 30. Therefore, rotation of the crankshaft 30 causes rotation of both the intake cam shaft 60 and the exhaust cam shaft 70. Due to the rotation of the intake cam shaft 60, an intake rocker arm 51 (FIG. 3) is swung at a predetermined timing, and due to the rotation of the exhaust cam shaft 70, an exhaust rocker arm 52 (FIG. 3) is swung at a predetermined timing. Consequently, a pressing portion 51*a* of the intake rocker arm 51 presses a shaft end portion 40*c* of each of the intake valves 40, and an end portion 52*a* of the exhaust rocker arms 52 presses a shaft end portion 41*c* of each of the exhaust valves 41. Accordingly, the intake valve openings 22*d* and the exhaust valve openings 22*e* are opened and closed at predetermined timings, respectively.

As described above, for opening and closing the intake valves 40 and the exhaust valves 41 at predetermined timings, is necessary to constantly maintain a tension of the cam chain 56 at a proper level. In the internal combustion engine E, to apply a fixed tension to the cam chain 56 for preventing free vibration of the cam chain 56, a cam chain guide 57 for guiding the cam chain 56 is provided as shown in FIG. 4, on a tension side of the cam chain 56 between the output sprocket 54 and one of the input sprockets 55, and a cam chain tensioner device 110 for pressing the cam chain 56 at a predetermined pressure is disposed on a slackening side of the cam chain 56 between the output sprocket 54 and the other of the input sprockets 55.

The cam chain tensioner device 110 includes: a cam chain tensioner 111 which presses the traveling cam chain 56 and slidably guides the cam chain 56; and a tensioner lifter 113 which presses the cam chain tensioner 111 at a predetermined pressure. The cam chain tensioner 111 is a low-pivot-type tensioner where a lower end portion 111*a* of the cam chain tensioner 111 on the side of the crankshaft 30 is swingably supported by the crankcase 20 by way of a collar 112, so that an upper end portion 111*b* of the cam chain tensioner ill is swingable. A plunger 115 of the tensioner lifter 113 is in contact from outside with an upper end portion 111*b* of the tensioner lifter 113. The tensioner lifter 113 is disposed on a rear surface of the cylinder head 22, which forms an inclined upper surface of the cylinder head 22, in a state where the tensioner lifter 113 is directed toward the cam chain 56. The tensioner lifter 113 is mounted on the cylinder head 22 in such an inclined manner that the tensioner lifter 113 presses the cam chain 56 upward.

In the above-mentioned valve train 50, it is necessary to supply lubricant oil for lubricating sliding surfaces and the like of the rotating intake cam shaft 60 and the exhaust cam shaft 70. Accordingly, as shown in FIG. 5, the internal combustion engine E includes a valve train oil supply passage 100 for supplying oil from an oil pump 36 to the valve train 50 including the intake cam shaft 60 and the exhaust cam shaft 70 of the valve train 50.

Further, the plunger 115 of the tensioner lifter 113 of the cam chain tensioner device 110 is moved in sliding movement, and hence it is necessary to impart lubrication property to the inside of the tensioner lifter 113 by using oil. Accordingly, a tensioner lifter oil supply passage 102*c* is branched from the valve train oil supply passage 100 at a branching portion 102*b* of the valve train oil supply passage 100 thus supplying oil also to the tensioner lifter 113. As shown in FIG. 5, the branching portion 102*b* is positioned at a position higher than the tensioner lifter 113, and is communicated with the tensioner lifter 113 disposed at a position lower than the branching portion 102*b* through a tensioner lifter oil supply passage 102*c*.

The valve train oil supply passage 100 is formed as follows.

Figure 5:
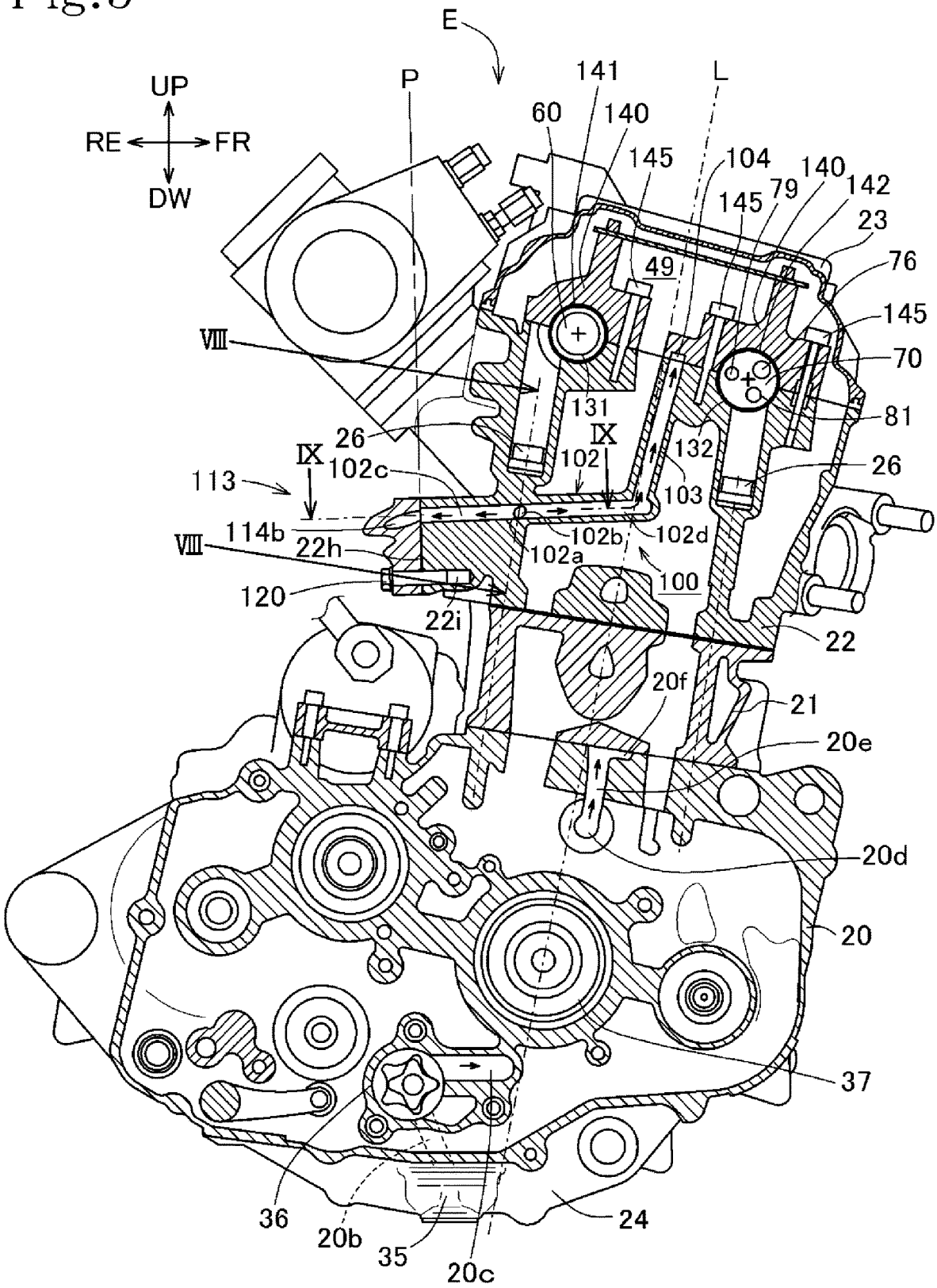
FIG. 5 is a longitudinal sectional view of the internal combustion engine taken along a line V-V in FIG. 13.

As shown in FIG. 5, the internal combustion engine E includes: the oil pump 36 which is driven in rotation when power of the crankshaft 30 is transmitted to the oil pump 36; and an oil filter 37 by which impurities are removed from oil before the oil from the oil pump 36 is fed to respective portions of the engine E. Oil delivered from the oil pump 36 through the oil filter 37 by which impurities are removed, is fed to the intake cam shaft 60, the exhaust cam shaft 70, and the tensioner lifter 113. The oil pump 36 has a shaft axis 33 as shown in FIGS. 2 and 6.

As depicted in FIG. 5, a strainer 35 is disposed in the oil pan 24, and the oil pump 36 for feeding lubricant oil to the respective portions of the internal combustion engine E is disposed on a lower portion of the crankcase 20. An oil passage 20*b* which connects the strainer 35 and a suction port of the oil pump 36 to each other is formed in the oil pan 24 and the crankcase 20.

Figure 6:
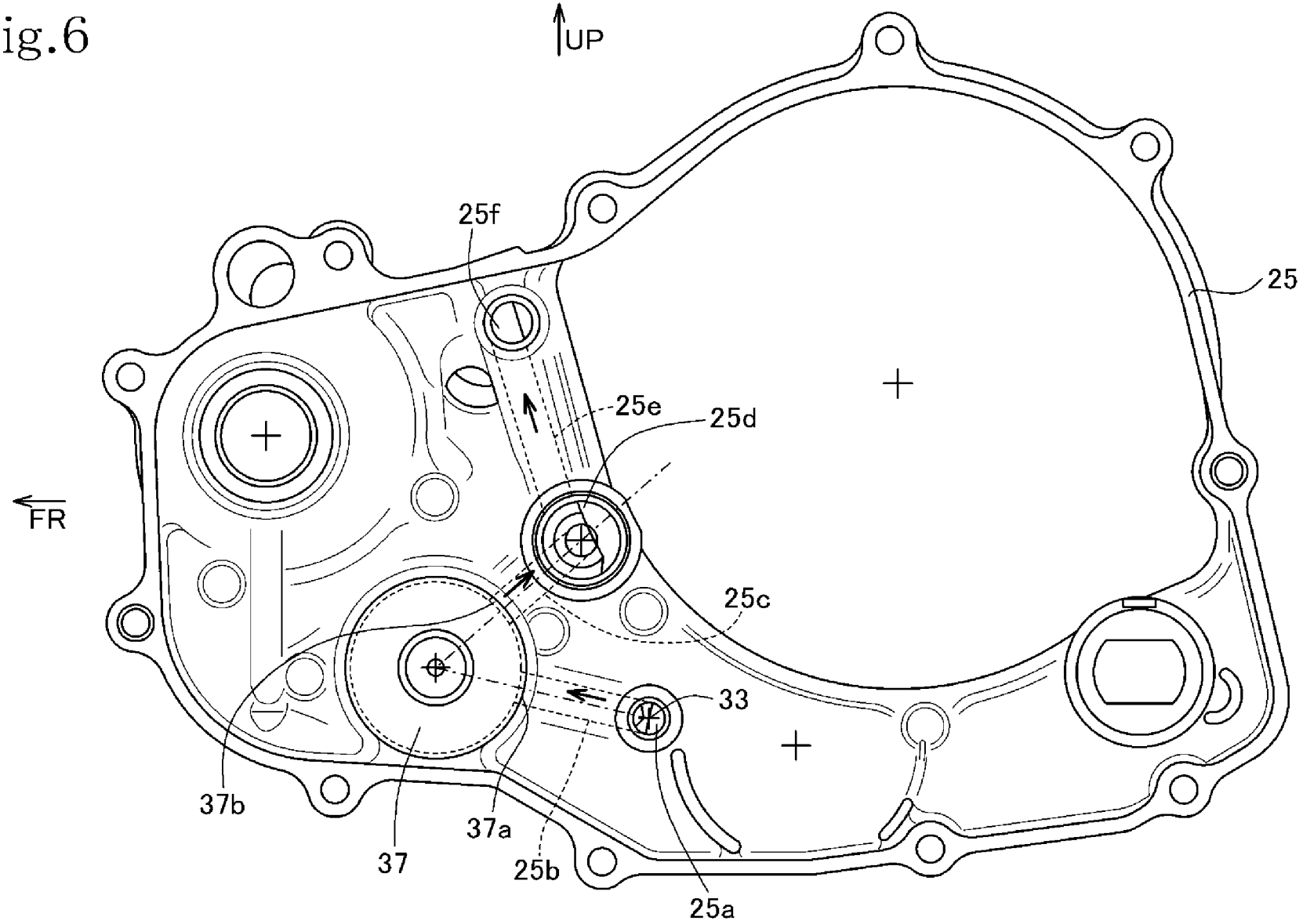
FIG. 6 is a view of a right case cover as viewed from inner side of the right case cover.

As shown in FIGS. 5 and 6, the oil filter 37, which is positioned at an approximately central portion of the crankcase 20 and removes impurities of lubricant, is held by being sandwiched between the crankcase 20 and the right case cover 25. An oil passage 20*c* is formed in the crankcase 20 to extend in a direction from a discharge port of the oil pump 36 to the oil filter 37.

An end portion of the oil passage 20*c* of the crankcase 20 is communicated with a communication port 25*a* which is formed in the wall of the right case cover 25 which is in contact with the crankcase 20 as shown in FIG. 6. In the right case cover 25 is formed an oil passage 25*b* which has one end thereof formed in the communication port 25*a*. The other end of the oil passage 25*b* is connected to an inflow port 37*a* of the oil filter 37. In the right case cover 25, an oil passage 25*c*, an oil reservoir 25*d*, and an oil passage 25*e* are continuously formed in this order from an outflow port 37*b* of the oil filter 37. An end portion of the oil passage 25*e* forms a communication port 25*f* which is communicated with the crankcase 20, thus being communicated with the communication port 20*d* (FIG. 5) of the crankcase 20.

As shown in FIG. 7, an oil passage 20*e* extends from the communication port 20*d* of the crankcase 20 toward the side of the cylinder body 21, and the oil passage 20*e* is connected to a mating surface oil passage 20*f* which is formed by cutting out, in a recessed shape, a mating surface of the crankcase 2U with the cylinder body 21.

As also shown in FIG. 7, the mating surface oil passage 20*f* is routed around the cylinder bore 21*a* and is formed so as to reach an area in the vicinity of one of the bolt holes 20*a* with which the stud bolt 26 positioned at a right rear side is in screw engagement. The mating surface oil passage 20*f* is connected to a communication passage 21*c* formed ranging from a mating surface of the cylinder body 21 with the crankcase 20 to other one of the bolt insertion holes 21*b*.

The bolt insertion holes 21*b* of the cylinder body 21 and the bolt insertion holes 22*b* of the cylinder head 22 are communicated with each other. End portions of the bolt insertion holes 22*b* formed in the cylinder head 22, on the side where the stud bolts 26 are inserted, are closed by head portions 26*a* of the stud bolts 26 when the stud bolts 26 are fastened. The bolt insertion holes 21*b* and 22*b* have a diameter greater than a diameter of the shaft portions 26*b* of the stud bolts 26. Accordingly, bolt insertion hole inner oil passages 101 which allow oil to pass therethrough are formed between the bolt insertion holes 21*b* and 22*b* and the shaft portions 26*b* of the stud bolts 26, respectively. The bolt insertion holes 21*b* and 22*b* used as the valve train oil supply passage 100 are formed on the side of one surface (side of a rear surface in this embodiment) of the cylinder body 21 and the cylinder head 22. The valve train oil supply passage 100 is lead to the intake cam shaft 60 and the exhaust cam shaft 70 disposed above the valve train oil supply passage 100 by making use of the bolt insertion holes 21*b* and 22*b* for fixing the cylinder body 21 and the cylinder head 22 to the crankcase 20.

Figure 8:
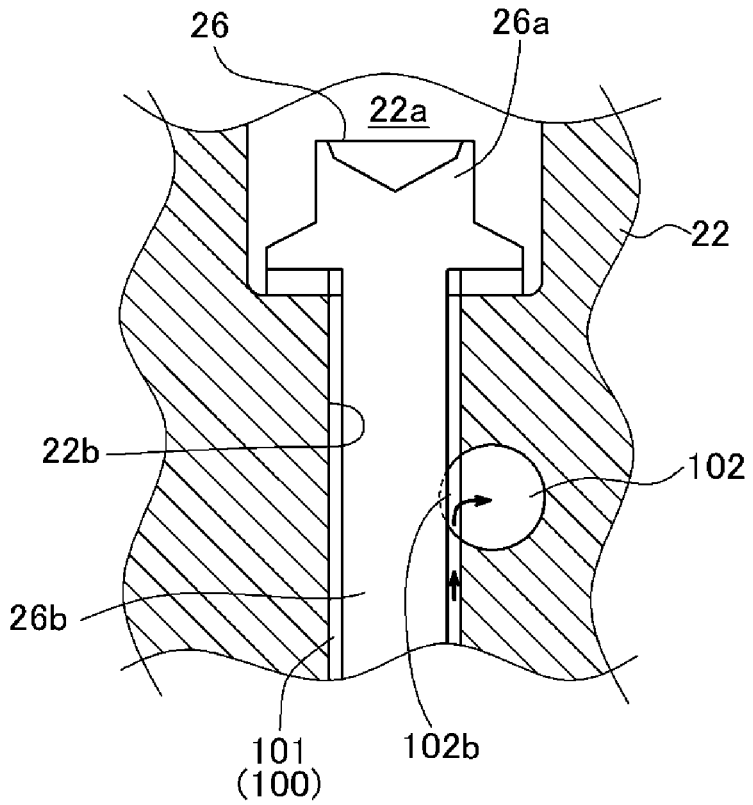
FIG. 8 is an enlarged sectional view of a part as viewed in a direction indicated by an arrow VIII-VIII in FIG. 7.
Figure 9:
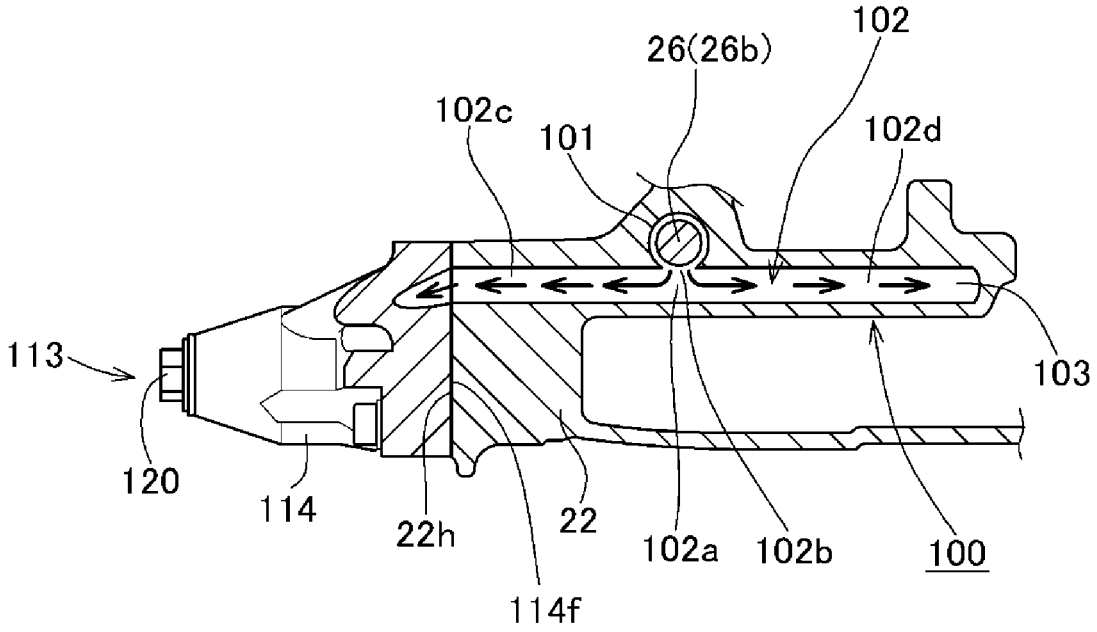
FIG. 9 is an enlarged sectional view of another part as viewed in a direction indicated by an arrow IX-IX in FIG. 5.

As shown in FIG. 5, a tensioner lifter mounting surface 22*h*, on which the tensioner lifter 113 is mounted, is formed on a rear surface of the cylinder head 22, and an oil passage 102 is formed in the cylinder head 22 such that the oil passage 102 extends frontward and obliquely upward from the tensioner lifter mounting surface 22*h*. As shown in FIGS. 8 and 9, an intermediate portion of the oil passage 102 in the longitudinal direction intersects with the bolt insertion hole inner oil passage 101 in a partially overlapping manner, and an intersecting portion of the oil passage 102 forms a communication port 102*a* through which the oil passage 102 is communicated with the bolt insertion hole inner oil passage 101. In the communication port 102*a* through which the oil passage 102 is communicated with the bolt insertion hole inner oil passage 101, the branching portion 102*b* is formed where the oil passage 102 is branched into the tensioner lifter oil supply passage 102*c* which extends rearward and through which oil is fed to the tensioner lifter 113 and a valve train side oil passage 102*d* which extends frontward and through which oil is fed to the intake cam shaft 60 and the exhaust cam shaft 70 of the valve train 50.

On a side close to the central portion of the cylinder head 22, a center oil passage 103 is formed such that the center oil passage 103 extends downward from a mating surface of the cylinder head cover 23 with the cam shaft holder 140. The valve train side oil passage 102*d* which forms a portion of the valve train oil supply passage 100 extends from the tensioner lifter oil supply passage 102*c*, passes the branching portion 102*b*, reaches an area close to the central portion of the cylinder head 22, and is communicated with the center oil passage 103. A front end portion of the valve train side oil passage 102*d* is connected to the center oil passage 103. An upper end of the center oil passage 103 communicates with a journal portion communicating oil passage 104 formed in the cam shaft holder 140.

Referring to FIG. 5, when power of the crankshaft 30 is transmitted to the oil pump 36 to operate the oil pump 36, oil reserved in the oil pan 24 flows from the strainer 35 through the oil passage 20*b* and is sucked into the oil pump 36. Oil discharged from the oil pump 36 and pressurized at a predetermined pressure, is delivered into the oil passage 25*b*, as shown in FIG. 6, through the communication port 25*a* formed in the right case cover 25, and then flows sequentially through the oil filter 37, the oil passage 25*c*, the oil reservoir 25*d*, and the oil passage 25*e*. Then the oil is fed to the communication port 20*d* disposed close to the cylinder body 21 of the crankcase 20 as shown in FIG. 5.

The oil fed to the communication port 20*d* passes though the oil passage 20*e* into the mating surface oil passage 20*f*, is fed into the bolt insertion hole 22*b* through the communication passage 21*c* in the cylinder body 21, flows through the bolt insertion hole inner oil passage 101, and is then fed into the cylinder head 22. More specifically, as shown in FIG. 5, the oil flows into the oil passage 102 through the communication port 102*a* of the bolt insertion hole inner oil passage 101, and the oil flow is divided in two flows at the branching portion 102*b*. One of the divided flows is fed through the tensioner lifter oil supply passage 102*c* into the tensioner lifter 113, and the other divided flow is fed through the valve train side oil passage 102*d* into the center oil passage 103 and then fed to the valve train 50.

As shown in FIG. 5, the tensioner lifter 113 of the cam chain tensioner device 110, to which oil is supplied from the tensioner lifter oil supply passage 102*c*, is mounted on the tensioner lifter mounting surface 22*h* formed on the rear surface of the cylinder head 22. As will be noted from FIGS. 4 and 5, the tensioner lifter mounting surface 22*h* is formed in an inclined direction opposite to a direction in which the cylinder axis L is inclined. In FIG. 5, a plane P indicates a plane including the tensioner lifter mounting surface 22*h*.

Figure 10:
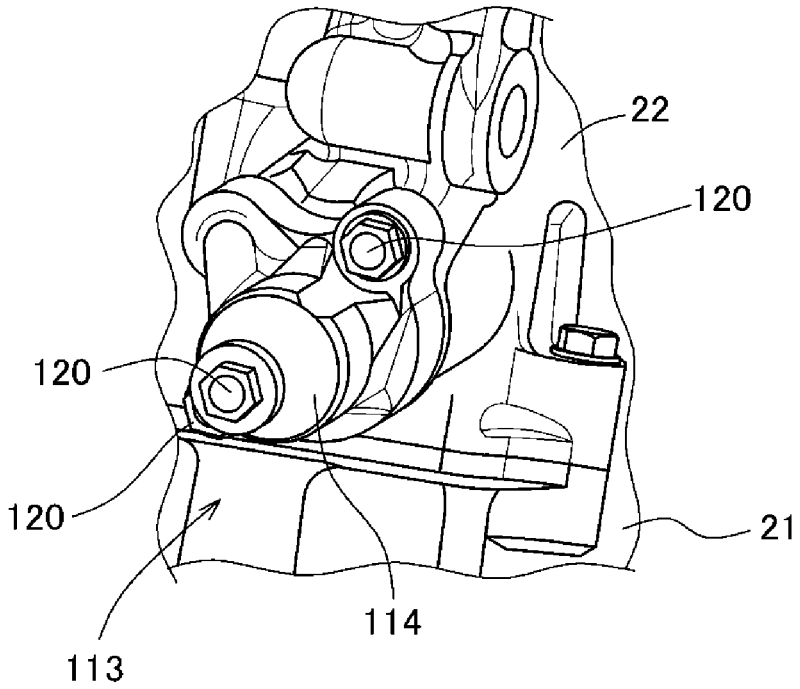
FIG. 10 is an enlarged perspective view of a part of the internal combustion engine around a tensioner lifter as viewed from an oblique right and rear side.
Figure 11:
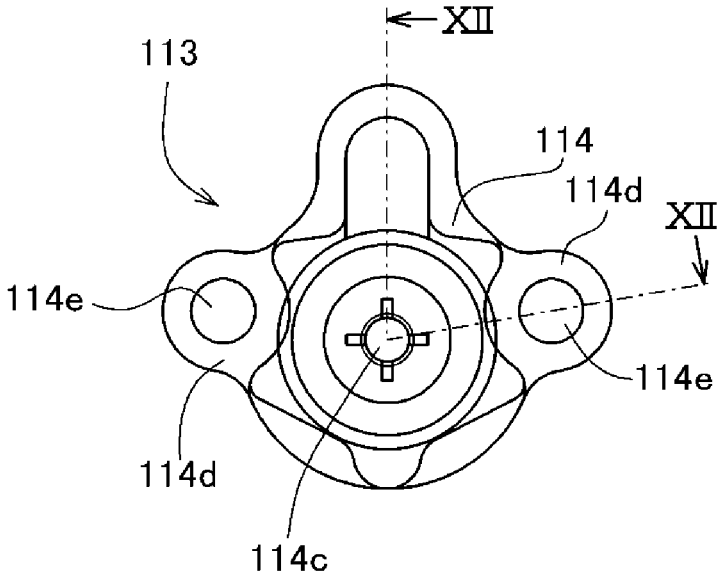
FIG. 11 is a view of the tensioner lifter as viewed from a rear side of the tensioner lifter.
Figure 12:
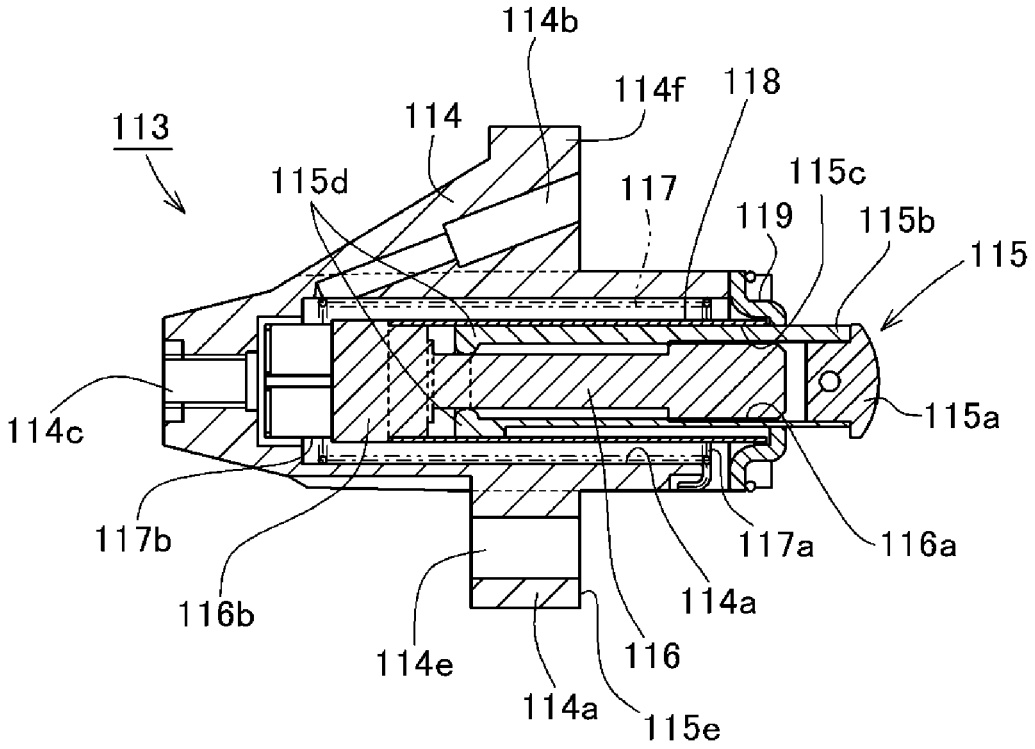
FIG. 12 is a sectional view of the tensioner lifter as viewed in a direction indicated by an arrow XII-XII in FIG. 11.

As shown in FIGS. 10, 11 and 12, the tensioner lifter 113 includes: a tensioner body 114 forming an outer shell of the tensioner lifter 113; and a plunger 115 having a distal end for pressing the cam chain tensioner 111. A plunger accommodating hole 114*a* in which the plunger 115 is accommodated is formed in the tensioner body 114. Flange portions 114*d* are formed to be positioned on left and right sides of the plunger accommodating hole 114*a*. A bolt insertion hole 114*e* is formed in each of the flange portions 114*d*. On a front surface of the tensioner body 114 is formed a mounting surface 115*e* which is brought into contact with the tensioner lifter mounting surface 22*h* of the cylinder head 22.

A male threaded member 116 is inserted into the plunger accommodating hole 114*a* of the tensioner body 114. The male threaded member 116 is formed in a circular columnar shape having a stepped portion with a rear end side having a larger diameter and a distal end side having a smaller diameter. The distal end side forms a male threaded portion 116*a* on which male threads are formed.

A torsion coil spring 117 is inserted in the plunger accommodating hole 114*a*, a rear end 117*b* of the torsion coil spring 117 is fixedly mounted on a rear end portion 116*b* of the male threaded member 116, and the other end 117*a* of the torsion coil spring 117 is fixed to a front side of the tensioner body 114.

The plunger 115 for pressing the cam chain tensioner 111 of the cam chain tensioner device 110 is inserted in the plunger accommodating hole 114*a* formed in the tensioner body 114. The plunger 115 includes: a cylindrical member 115*b* in which a front portion of the male threaded member 116 is inserted; and a pressing member 115*a* fitted in a distal end of the cylindrical member 115*b* to press the cam chain tensioner 111. A female threaded portion 115*c* in screw engagement with the male threaded portion 116*a* of the male threaded member 116 is formed on an inner side of the cylindrical member 115*b*. A stopper portion 115*d* for preventing axial removal of the plunger 115 is formed on a rear end of the cylindrical member 115*b* in a radially inwardly projecting manner.

A cylindrical collar member 118 is fitted on the plunger 115 so as to extend to a region to cover the stepped portion of the male threaded member 116, the plunger 115 is inserted in a plunger insertion hole formed in a cap member 119, and the cap member 119 is fixed to the tensioner body 114. The plunger 115 is formed such that advancing and retracting movement of the plunger 115 are allowable but rotation of the plunger 115 is restricted by the cap member 119.

A tool insertion hole 114*c* is formed in a rear end of the tensioner body 114. A tool to be inserted in the tool insertion hole 114*c* is a tool for rotating the male threaded member 116. When the tool (not shown) for rotating the male threaded member 116 is inserted into the tool insertion hole 114*c* and the male threaded member 116 is rotated in a predetermined direction, the plunger 115 is retracted to the inside of the tensioner body 114, and, at the same time, the torsion coil spring 117 is twisted. In such a state, the pressing member 115*a* of the plunger 115 of the tensioner lifter 113 is directed toward the cam chain tensioner 111 and is brought into contact with the cam chain tensioner 111, while, at the same time, the mounting surface 114*f* of the tensioner body 114 is brought into contact with the tensioner lifter mounting surface 22*h* which forms the rear surface of the cylinder head 22. Then, bolts 120 (FIG. 10) are inserted into the bolt insertion holes 114*e* formed in the tensioner body 114 of the tensioner lifter 113, and the bolts 120 are tightened perpendicularly to the tensioner lifter mounting surface 22*h* so that the tensioner lifter 113 is fixedly mounted on the cylinder head 22. As shown in FIG. 5, bolt holes 22*i* formed in the cylinder head 22 for screw engagement with the bolts 120 and the tensioner lifter oil supply passage 102*c* are formed parallel to each other. By arranging the bolt holes 22*i* and the tensioner lifter oil supply passage 102*c* in the same direction, machinability can be improved.

When the tool for rotating the male threaded member 116 is removed after the tensioner lifter 113 is mounted on the cylinder head 22, the restoring force of the torsion coil spring 117 operates to rotate the male threaded member 116, and, at the same time, the plunger 115 having the female threaded portion 115*c* in screw engagement with the male threaded member 116 advances toward the cam chain tensioner 111 thus pressing the cam chain tensioner 111. As shown in FIGS. 9 and 10, another bolt 120 is threadedly engaged in the tool insertion holes 114*c* to close the tool insertion holes 114*c*.

Next, description will be made with respect to the valve train 50 which includes the intake cam shaft 60 and the exhaust cam shaft 70 to which oil is fed through the valve train oil supply passage 100, and through oil passages formed in the valve train 50.

Figure 14:
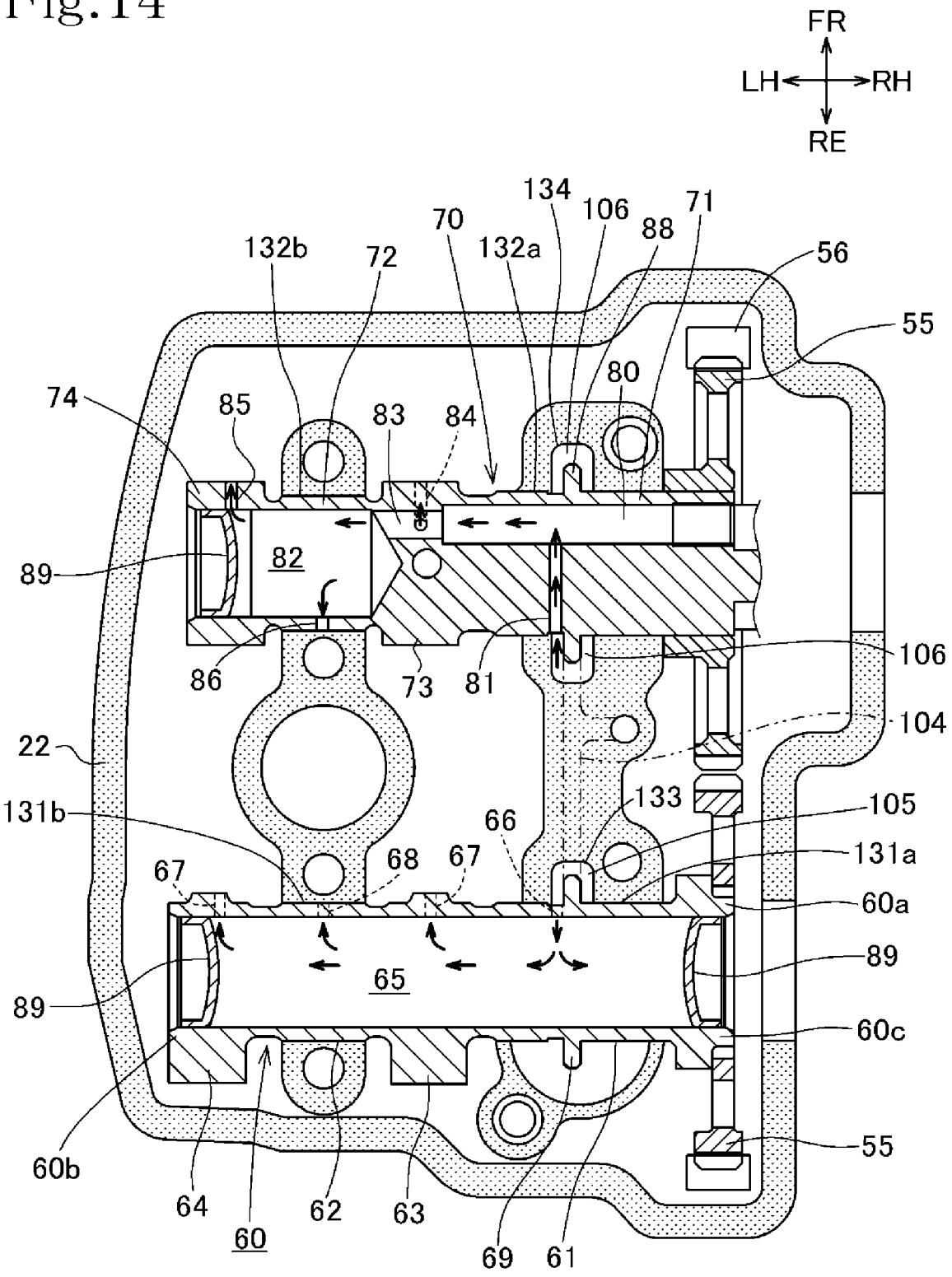
FIG. 14 is a sectional view of the internal combustion engine as viewed in a direction indicated by an arrow XIV-XIV in FIG. 7.

The intake cam shaft 60 for closing and opening the intake valves 40 is shown in FIGS. 13 and 14. A first bearing journal portion 61 supported by the cylinder head 22 is formed on a right end portion 60*a* of the intake cam shaft 60, and a second bearing journal portion 62 is formed on a left end portion 60*b* of the intake cam shaft 60. A first intake cam 63 and a second intake cam 64, forming valve operating cam portions, are integrally formed with the intake cam shaft 60. The second intake cam 64 is formed on the left end portion 60*b* of the intake cam shaft 60, and the first intake cam 63 is disposed at a position between the first bearing journal portion 61 and the second bearing journal portion 62. An input sprocket mounting portion 60*c* is formed on a right end portion 60*a* of the intake cam shaft 60, and an input sprocket 55 for driving the intake cam shaft 60 is mounted on the input sprocket mounting portion 60*c*.

The intake cam shaft 60 is formed of a hollow sleeve-shaped member, the right end portion 60*a* and the left end portion 60*b* of the intake cam shaft 60 are closed by fitting closing members 89 into each of the right end portion 60*a* and the left end portion 60*b*. An intake cam shaft inner oil passage 65 is formed in the intake cam shaft 60 and oil passes through the intake cam shaft inner oil passage 65. An annular flange portion 69 is formed on the first bearing journal portion 61, the portion 69 protruding in a flange shape in radial directions to restrict movement of the intake cam shaft 60 in the thrust direction.

As shown in FIG. 13, the first bearing journal portion 61 of the intake cam shaft 60 has an intake cam shaft supply passage 66 communicating with the intake cam shaft inner oil passage 65, and the intake cam shaft supply passage 66 is disposed adjacent to the flange portion 69. In the second bearing journal portion 62 is formed a journal bearing oil supply passage 68 communicating with the intake cam shaft inner oil passage 65, and oil is fed from within the intake cam shaft 60 to an outer peripheral surface of the second bearing journal portion 62.

In each of the first intake cam 63 and the second intake cam 64 is formed a cam surface oil supply passage 67 which extends from within the intake cam shaft inner oil passage 65*a* to the cam surface. Oil is fed from within the intake cam shaft 60 to the cam surface of the first intake cam 63 and to the cam surface of the second intake cam 64.

The exhaust cam shaft 70 for opening and closing the exhaust valves 41 is shown in FIGS. 17 to 21.

Figure 21:
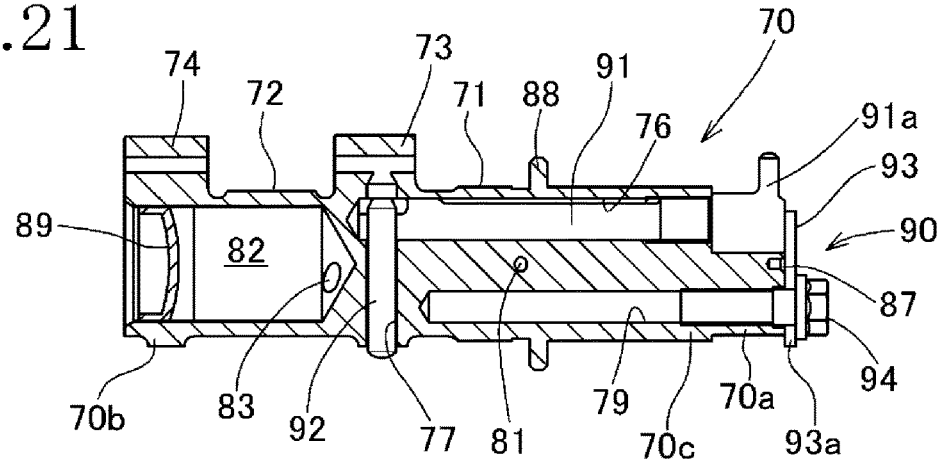
FIG. 21 is a view showing a configuration where a decompression device is mounted on the exhaust cam shaft shown in FIG. 17.

As shown in FIG. 21, the exhaust cam shaft 70 includes a centrifugal decompression device 90 which makes use of rotation of the exhaust cam shaft 70. The decompression device 90 includes: a decompression shaft 91 on which a decompression weight 91*a* is integrally formed; a decompression pin 92 which advances or retracts from a cam surface of an exhaust cam 73 to be described later in connection with rotation of the decompression shaft 91; and a torsion coil spring (not shown) which biases the decompression shaft 91 in a rotational direction.

The decompression shaft 91 is constantly biased by the torsion coil spring in a direction in which the decompression weight 91*a* is brought into contact with a decompression weight swing restricting portion 78, to be described later, formed on the exhaust cam shaft 70. In such a state, the decompression pin 92 so protrudes from the cam surface of the exhaust cam 73 to bring about a decompression state in which the exhaust valve 41 is so released that pressure is lowered even when the internal combustion engine E is in the compression stroke. That is, when a rotational speed of the exhaust cam shaft 70 is equal to or below a predetermined rotational speed at the time of starting the internal combustion engine E, the decompression device 90 is brought into the above-mentioned decompressed state.

When the internal combustion engine E is started and a rotational speed of the exhaust cam shaft 70 becomes equal to or more than the predetermined rotational speed, the decompression weight 91*a* moves outward from the exhaust cam shaft 70 due to a centrifugal force, and retracts the decompression pin 92 by rotating the decompression shaft 91 against the biasing force of the torsion coil spring, thus bringing the decompression device 90 into a non-decompressed state from the decompressed state.

The configuration of the exhaust cam shaft 70 will be described hereinafter. As shown in FIGS. 13 and 14, the exhaust cam shaft 70 has a first bearing journal portion 71 supported by the cylinder head 22 and disposed close to the right end portion 70*a*, and a second bearing journal portion 72 on a left end portion 70*b* of the exhaust cam shaft 70. The right first bearing journal portion 71 has a diameter $d_1$ set greater than a diameter $d_2$ of the left second bearing journal portion 72.

In addition to the exhaust cam 73, i.e., the first exhaust cam 73, a second exhaust cam 74 is provided on the exhaust cam shaft 70. The first and second exhaust cams 73 form the valve operating cam portions integrally formed on the exhaust cam shaft 70. The second exhaust cam 73 is positioned on a left end portion 70*b* of the exhaust cam shaft 70, and the first exhaust cam 73 is formed at a position between the first bearing journal portion 71 and the second bearing journal portion 72. On the first bearing journal portion 71 is formed a flange portion 88 which protrudes in a flange shape in radial directions to restrict the movement of the exhaust cam shaft 70 in the thrust direction. An input sprocket mounting portion 70*c* is formed on a right end portion 70*a* of the exhaust cam shaft 70, and the input sprocket 55 for driving the exhaust cam shaft 70 is mounted on the input sprocket mounting portion 70*c*.

Figure 17:
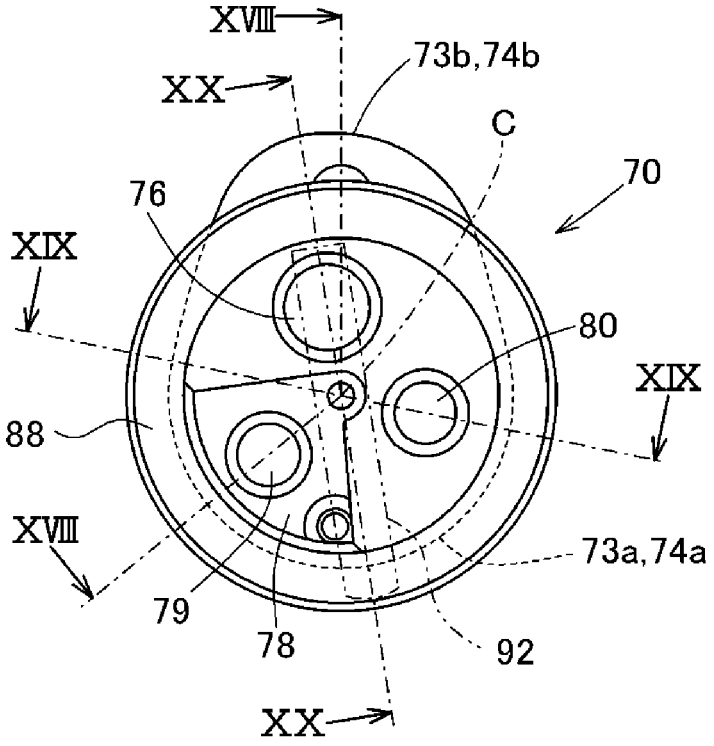
FIG. 17 is a right side view of the exhaust cam shaft.

As shown in FIG. 17, the first exhaust cam 73 and the second exhaust cam 74 include: base circle portions 73*a* and 74*a* of a circular arc shape about an axis of the exhaust cam shaft 70, respectively; and cam crest portions 73*b* and 74*b* which are respectively continuously formed with the base circle portions 73*a* and 74*a* to radially outwardly protruding manner from the base circle portions 73*a* and 74*a*. As shown in FIG. 3, the first intake cam 63 and the second intake cam 64 are formed in the same manner as the first exhaust cam 73 and the second exhaust cam 74. That is, the first intake cam 63 and the second intake cam 64 include: base circle portions 63*a* and 64*a* of a circular arc shape about an axis of the intake cam shaft 60; and cam crest portions 63*b* and 64*b* which are respectively continuously formed with the base circle portions 63*a* and 64*a* in a radially outwardly protruding manner than the base circle portions 63*a* and 64*a*.

Figure 18:
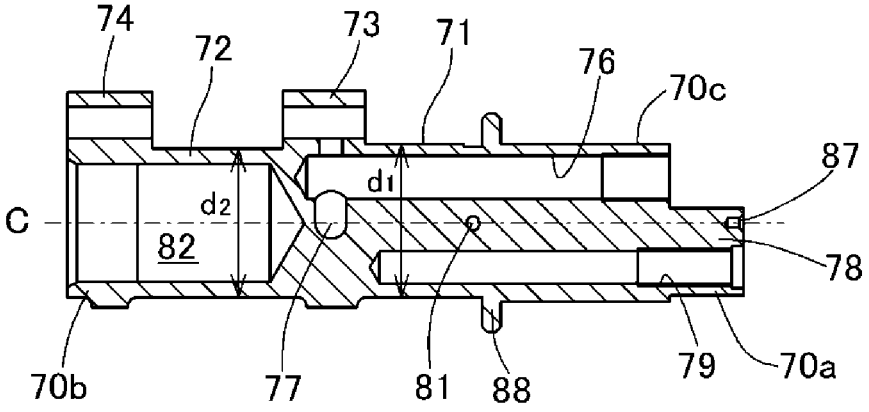
FIG. 18 is a sectional view of the exhaust cam shaft as viewed in a direction indicated by an arrow XVIII-XVIII in FIG. 17.

As shown in FIGS. 17 and 18, on the right end portion 70*a* of the exhaust cam shaft 70 is formed the decompression weight swing restricting portion 78, which is of a sector shape in cross section and is formed in a protruding manner in an area offset from the axis C of the exhaust cam shaft 70. As FIG. 21 shows, the decompression weight 91*a* integrally formed with the decompression shaft 91 which is biased by the torsion coil spring is brought into contact with a side surface of the decompression weight swing restricting portion 78. The decompression weight swing restricting portion 78 restricts rotation of the decompression weight 91*a*. On the decompression weight swing restricting portion 78 is formed a center hole portion 87 which is used as a reference in machining the exhaust cam shaft 70.

Figure 20:
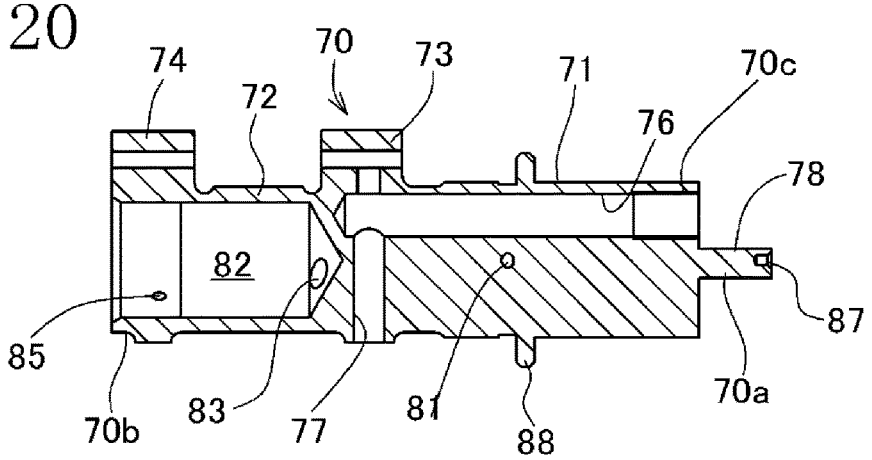
FIG. 20 is a sectional view of the exhaust cam shaft as viewed in a direction indicated by an arrow XX-XX in FIG. 17.

As shown in FIGS. 18 and 20, a decompression shaft hole 76, in which the decompression shaft 91 of the decompression device 90 is inserted, is formed in the exhaust cam shaft 70. The decompression shaft hole 76 extends to an area between the first bearing journal portion 71 and the second bearing journal portion 72 in an axial direction toward the first exhaust cam 73 from the right end portion 70*a* adjacent to the portion on which the input sprocket 55 is mounted. The decompression shaft hole 76 is formed in parallel to the axis C of the exhaust cam shaft 70. As shown in FIG. 17, the decompression shaft hole 76 is disposed at a position offset from the axis C of the exhaust cam shaft 70.

As shown in FIG. 18, a decompression shaft removal preventing threaded portion 79 is formed in the decompression weight swing restricting portion 78 parallel to the decompression shaft hole 76. As FIG. 21 shows, a bolt 94 for preventing removal of the decompression shaft 91 is engaged with the decompression shaft removal preventing threaded portion 79.

As shown in FIG. 17, the decompression shaft removal preventing threaded portion 79 is formed in an offset manner from the axis C of the exhaust cam shaft 70 as viewed in the axial direction of the exhaust cam shaft 70 and is positioned at an approximately center of the decompression weight swing restricting portion 78. The decompression shaft removal preventing threaded portion 79 is formed to have a through hole formed in the first bearing journal portion 71. As shown in FIG. 21, after the decompression shaft 91 is inserted into the decompression shaft hole 76, a plate-like decompression shaft removal preventing member 93 is brought into contact with the decompression shaft 91 from the right side, a bolt 94 is inserted into the bolt insertion hole 93*a* formed in the decompression shaft removal preventing member 93, and the bolt 94 is engaged in and tightened with the decompression shaft removal preventing threaded portion 79, thus preventing removal of the decompression shaft 91.

Figure 19:
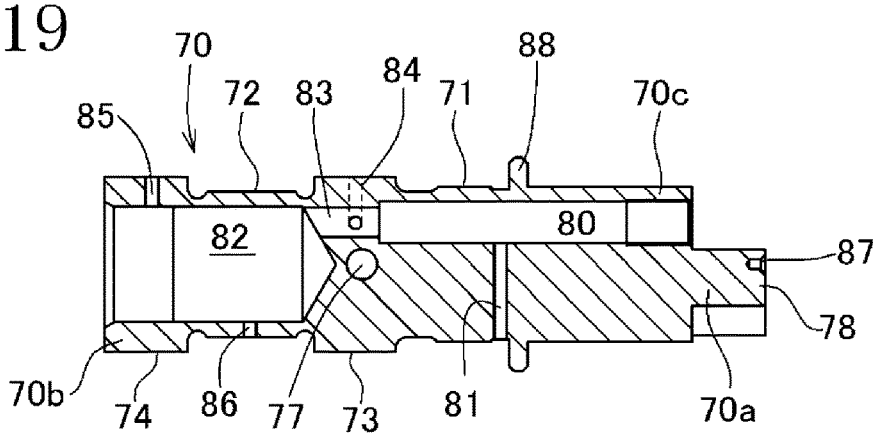
FIG. 19 is a sectional view of the exhaust cam shaft as viewed in a direction indicated by an arrow XIX-XIX in FIG. 17.

As shown in FIGS. 17 to 19, an exhaust cam shaft inner oil passage 80 extending parallel to the decompression shaft hole 76 is formed in the exhaust cam shaft 70. The exhaust cam shaft inner oil passage 80 extends from a right end portion 70*a* toward a left end portion 70*b* of the exhaust cam shaft 70. The exhaust cam shaft inner oil passage 80 is provided for supplying lubricant oil from the first bearing journal portion 71 to the second bearing journal portion 72. As shown in FIG. 17, the exhaust cam shaft inner oil passage 80 is disposed on the other side of the decompression shaft removal preventing threaded portion 79 with respect to the decompression pin 92, as viewed in the axial direction of the exhaust cam shaft 70.

Referring to FIG. 19, an oil reservoir 82 for reserving oil therein is formed in the exhaust cam shaft 70. The oil reservoir 82 extends rightward from a left end surface of the exhaust cam shaft 70. The oil reservoir 82 extends axially to an area in the vicinity of the first exhaust cam 73, and an opening portion formed on a left end of the reservoir 82 is closed by a closing member 89. The oil reservoir 82 and the exhaust cam shaft inner oil passage 80 are communicated with each other through a communication passage 83.

As shown in FIG. 19, the first bearing journal portion 71 of the exhaust cam shaft 70 has therein an exhaust cam shaft oil supply passage 81 adjacent to the flange portion 88. The exhaust cam shaft oil supply passage 81 is communicated with the exhaust cam shaft inner oil passage 80. Further, a journal bearing oil supply passage 86 is formed in the second bearing journal portion 72, so as to communicate with the oil reservoir 82, and oil is fed from inside of the exhaust cam shaft 70 to an outer peripheral surface of the second bearing journal portion 72.

A cam surface oil supply passage 84 is formed in the first exhaust cam 73 to extend from a cam surface of the first exhaust cam 73 to the communication passage 83. A cam surface oil supply passage 85 is formed in the second exhaust cam 74 to extend from a cam surface of the second exhaust cam 74 to communicate with the oil reservoir 82. Due to the formation of the cam surface oil supply passages 84 and 85, oil is fed from inside of the exhaust cam shaft 70 to the cam surfaces of the first exhaust cam 73 and the second exhaust cam 74.

The above-mentioned intake cam shaft 60 and the exhaust cam shaft 70 are rotatably supported as follows. That is, as shown in FIG. 5, the intake cam shaft 60 is placed on a head-side intake journal receiving portion 131 formed on the cylinder head 22, and the exhaust cam shaft 70 is placed on a head-side exhaust journal receiving portion 132 formed on the cylinder head 22. The intake cam shaft 60 and the exhaust cam shaft 70 are held by the respective cam shaft holders 140 such that a holder-side intake journal receiving portion 141 and a holder-side exhaust journal receiving portion 142 formed on the cam shaft holder 140 are in contact with the intake cam shaft 60 and the exhaust cam shaft 70, respectively. Then, the cam shaft holders 140 are fixed to the cylinder head 22 using bolts 145. As shown in FIG. 13, the intake cam shaft 60 and the exhaust cam shaft 70 are disposed parallel to each other with the center of the cylinder head 22 sandwiched therebetween as viewed in a direction of a cylinder axis L.

As shown in FIG. 14, the head-side intake journal receiving portion 131 is formed of: a first head-side intake journal receiving portion 131*a* which supports the first bearing journal portion 61 of the intake cam shaft 60; and a second head-side intake journal receiving portion 131*b* which supports the second bearing journal portion 62. The head-side exhaust journal receiving portion 132 is formed of: a first head-side exhaust journal receiving portion 132*a* which supports the first bearing journal portion 71 of the exhaust cam shaft 70; and a second head-side exhaust journal receiving portion 132*b* which supports the second bearing journal portion 72.

Figure 15:
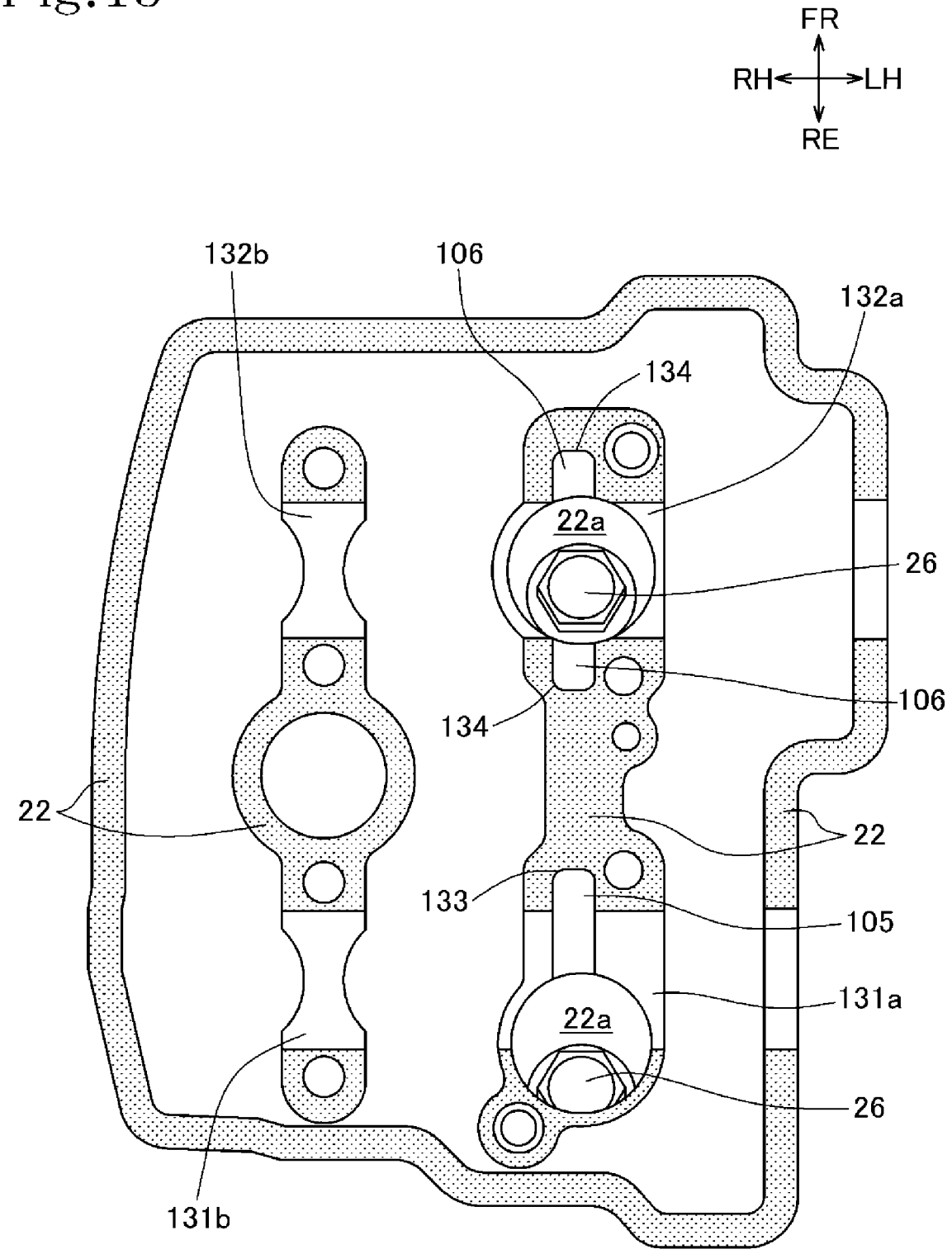
FIG. 15 is a view showing a configuration where an intake cam shaft and an exhaust cam shaft are removed from the configuration shown in FIG. 14.
Figure 16:
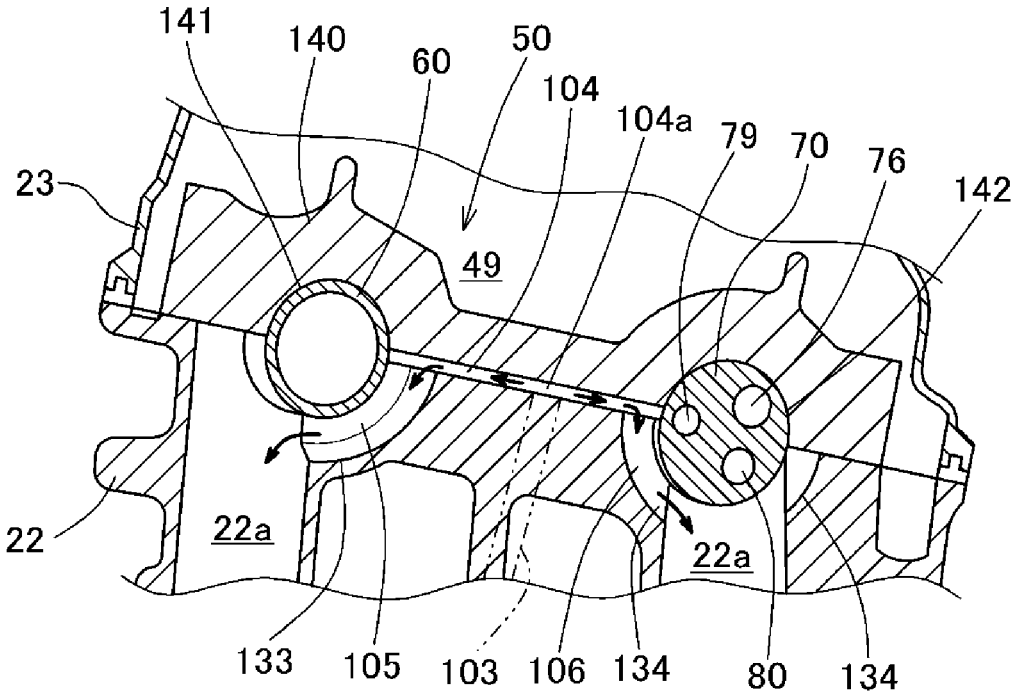
FIG. 16 is a longitudinal cross-sectional view of the internal combustion engine taken along a line XVI-XVI in FIG. 13.

As shown in FIGS. 14 to 16, a recessed portion 133 is formed in the first head-side intake journal receiving portion 131*a* such that a gap is left in the recessed portion 133 between the first head-side intake journal receiving portion 131*a* and the flange portion 69 of the intake cam shaft 60. The recessed portion 133 is communicated with the bolt accommodating hole 22*a* disposed below the first head-side intake journal receiving portion 131*a*. A recessed portion 134 is also formed in the first head-side exhaust journal receiving portion 132*a* such that a gap is left between the first head-side exhaust journal receiving portion 132*a* and the flange portion 88 of the exhaust cam shaft 70. The recessed portion 134 is communicated with the bolt accommodating hole 22*a* disposed below the first head-side exhaust journal receiving portion 132*a*.

Next, the cam shaft holders 140 will be described. FIG. 13 is a cross-sectional view of the internal combustion engine as viewed in a direction indicated by an arrow XIII-XIII in FIG. 7. The cam shaft holders 140 are shown in a section taken parallel to the mating surface between the cam shaft holders 140 and the cylinder head 22.

As shown in FIG. 5, the holder-side intake journal receiving portion 141 and the holder-side exhaust journal receiving portion 142 are formed on lower surfaces of the cam shaft holders 140. As shown in FIG. 13, the holder-side intake journal receiving portion 141 is formed of a first holder-side intake journal receiving portion 141*a* which supports the first bearing journal portion 61 of the intake cam shaft 60, and a second holder-side intake journal receiving portion 141*b* which supports the second bearing journal portion 62 of the intake cam shaft 60. The holder-side exhaust journal receiving portion 142 is formed of a first holder-side exhaust journal receiving portion 142*a* which supports the first bearing journal portion 71 of the exhaust cam shaft 70, and a second holder-side exhaust journal receiving portion 142*b* which supports the second bearing journal portion 72 of the exhaust cam shaft 70.

In the first holder-side intake journal receiving portion 141*a* is formed a thrust restricting recessed portion 143 in which the flange portion 69 is fitted. The thrust restricting recessed portion 143 is formed by cutting out the first holder-side intake journal receiving portion 141*a* into a semicircular shape having the same width as the flange portion 69 of the intake cam shaft 60, thus restricting movement of the intake cam shaft 60 in the thrust direction. In the first holder-side exhaust journal receiving portion 142*a* is formed a thrust restricting recessed portion 144 in which the flange portion 88 is fitted. The thrust restricting recessed portion 144 is formed by cutting out the first holder-side exhaust journal receiving portion 142*a* into a semicircular shape having the same width as the flange portion 88 of the exhaust cam shaft 70, thus restricting movement of the exhaust cam shaft 70 in the thrust direction.

As shown in FIG. 5, the journal portion communicating oil passage 104, which communicates with an upper end of the center oil passage 103 of the valve train oil supply passage 100, is formed on a lower surface of the cam shaft holder 140. As shown in FIG. 13, the journal portion communicating oil passage 104 is formed to extend parallel to the exhaust cam shaft 70, from an end portion thereof communicating with the center oil passage 103. The journal portion communicating oil passage 104 is branched in a direction toward the intake cam shaft 60 and in a direction toward the exhaust cam shaft 70. As FIG. 13 shows, an end portion of the journal portion communicating oil passage 104 extending in the direction to the intake cam shaft 60 is connected to the thrust restricting recessed portion 143. As shown in FIGS. 14 and 16, the end portion of the journal portion communicating oil passage 104 is communicated with an intake journal receiving portion oil passage 105 in the recessed portion 133. As shown in FIG. 13, an end portion of the journal portion communicating oil passage 104 extending in the direction to the exhaust cam shaft 70 is connected to the thrust restricting recessed portion 144. As shown in FIGS. 14 and 16, the end portion of the journal portion communicating oil passage 104 is communicated with an exhaust journal receiving portion oil passage 106 in the recessed portion 134.

The oil passage to the intake cam shaft 60 and the oil passage to the exhaust cam shaft 70 are formed as described above. Accordingly, oil pressurized to a predetermined pressure is fed to the respective portions by the oil pump 36 through the valve train oil supply passages 100 as follows.

The oil passes from the oil pump 36 through the bolt insertion hole inner oil passage 101 (FIG. 7), the valve train side oil passage 102*d* (FIG. 5), and the center oil passage 103. Then, as shown in FIG. 13, the oil flows from the upper end of the center oil passage 103 through a branching portion 104*a* of the journal portion communicating oil passage 104 to the intake cam shaft 60, and, as shown in FIG. 16, the oil is fed to the intake journal receiving portion oil passage 105. The oil fed to the intake journal receiving portion oil passage 105 is reserved in the bolt accommodating hole 22*a*, and as shown in FIG. 14, the oil flows into the intake cam shaft 60 through the intake cam shaft supply passage 66 so that the oil is supplied from the cam surface oil supply passages 67 to the cam surfaces of the intake cams 63 and 64. The oil is supplied also to the second head-side intake journal receiving portion 131*b* through the journal bearing oil supply passage 68.

As shown in FIG. 13, oil flowing from the branching portion 104*a* of the journal portion communicating oil passage 104 to the exhaust cam shaft 70 is fed to the exhaust journal receiving portion oil passage 106 as shown in FIG. 16. Oil which is fed to the exhaust journal receiving portion oil passage 106 is reserved in the bolt accommodating hole 22*a*, and flows into the exhaust cam shaft 70 through the exhaust cam shaft oil supply passage 81 disposed adjacent to the flange portion 88 of the exhaust cam shaft 70 as shown in FIG. 14 so that the oil is supplied to the cam surfaces of the exhaust cams 73 and 74 through the cam surface oil supply passages 84 and 85, and the oil is supplied to the second head-side exhaust journal receiving portion 132*b* through the journal bearing oil supply passage 86.

Due to the above-described configuration of the embodiment, the following advantageous effects can be acquired.

In the internal combustion engine E according to the embodiment, the exhaust cam shaft 70 mounted on the cylinder head 22 is constituted as a portion of the valve train oil supply passage 100, and the centrifugal decompression device 90 which makes use of rotation of the cam shaft 70 is provided. Further, the first bearing journal portion 71 supported by the cylinder head 22 is disposed on the right end portion 70*a* of the exhaust cam shaft 70, the second bearing journal portion 72 is disposed on the left end portion 70*b* of the exhaust cam shaft 70, the input sprocket mounting portion 70*c* serving to drive the exhaust cam shaft 70 is disposed on the right end portion 70*a* of the exhaust cam shaft 70, and the second exhaust cam 74 is disposed on the left end portion 70*b*. Furthermore, the decompression shaft hole 76, in which the decompression shaft 91 of the decompression device 90 is fitted, is formed in an axial direction from the input sprocket mounting portion 70*c* toward the second exhaust cam 74, the decompression shaft hole 76 is formed at a position offset from the axis C of the cam shaft 70, and the exhaust cam shaft inner oil passage 80 is formed to extend from the right end portion 70*a* toward the left end portion 70*b* of the cam shaft 70 in parallel arrangement to the decompression shaft hole 76, to supply lubricant from the first bearing journal portion 71 to the second bearing journal portion 72. Therefore, lubricant can be supplied from the first bearing journal portion 71 to the second bearing journal portion 72 using the additional exhaust cam shaft inner oil passage 80 without using the decompression shaft hole 76 as an oil passage. Accordingly, it is possible to supply a sufficient amount of oil to the respective areas of sliding portions of the valve train.

On the right end portion 70*a* of the exhaust cam shaft 70, the decompression weight swing restricting portion 78 for restricting rotational movement of the decompression weight 91*a* rotatable integrally with the decompression shaft 91, is disposed at a position offset from the axis C of the exhaust cam shaft 70. Further, on the decompression weight swing restricting portion 78 is disposed the decompression shaft removal preventing threaded portion 79 with which the bolt 94 for preventing removal of the decompression shaft 91 is threadedly engaged, and the decompression shaft removal preventing threaded portion 79 is disposed at a position offset from the axis C of the exhaust cam shaft 70 in parallel arrangement to the decompression shaft hole 76. Accordingly, the decompression weight swing restricting portion 78 and the decompression shaft removal preventing threaded portion 79 can be arranged on the right end portion 70*a* of the exhaust cam shaft 70 in a collective manner, and hence the exhaust cam shaft inner oil passage 80 of enlarged size can be formed, whereby it is possible to supply an increased amount of oil to the valve train.

Further, the decompression device 90 includes the decompression pin 92 capable of advancing from and retracting to the first exhaust cam 73 in connection with rotation of the decompression shaft 91. The exhaust cam shaft 70 includes the first exhaust cam 73 disposed between the first bearing journal portion 71 and the second bearing journal portion 72, and the second exhaust cam 74 axially outside the second bearing journal portion 72. The decompression shaft hole 76 extends axially to an area between the first bearing journal portion 71 and the second bearing journal portion 72, the exhaust cam shaft inner oil passage 80 is disposed on a side opposite to the decompression shaft removal preventing threaded portion 79 with respect to the decompression pin 92 as viewed in the axial direction of the cam, and the exhaust cam shaft inner oil passage 80 is formed to reach the second exhaust cam 74 on an axially far side without interfering with the decompression pin 92. It is therefore possible to supply a sufficient amount of oil also to the exhaust cam 74 on an axially far side.

Furthermore, the diameter $d_1$ of the first bearing journal portion 71 is set greater than the diameter $d_2$ of the second bearing journal portion 72, and the decompression shaft removal preventing threaded portion 79 is formed to extend axially in the region of the first bearing journal portion 71. Accordingly, by forming only the first bearing journal portion 71 in the axial region where the decompression shaft removal preventing threaded portion 79 is formed, to have enlarged diameter, it is possible to increase the size of the bearing journal portion, keeping a required minimum size of the exhaust cam shaft 70, and hence the weight of the exhaust cam shaft 70 can be reduced.

The center hole portion 87 serving as a reference in machining the exhaust cam shaft 70 is formed on the decompression weight swing restricting portion 78 of the exhaust cam shaft 70, and machinability of the exhaust cam shaft 70 is enhanced by providing the center hole portion 87 in the end portion of the exhaust cam shaft 70, and the surface around the center hole portion 87 can be used as the decompression weight swing restricting portion 78 for restricting movable position of the decompression weight 91*a*.

On the surface of the cylinder head 22 on the head cover 23, the bolt accommodating hole 22*a* is formed which accommodates the stud bolt 26 for fastening the crankcase 20 and the cylinder body 21 of the engine E to each other. The first bearing journal portion 71 is supported by the first head-side exhaust journal receiving portion 132*a* disposed above the bolt accommodating hole 22*a* of the cylinder head 22 and the first holder-side exhaust journal receiving portion 142*a* formed on the cam shaft holder 140, which is positioned above the exhaust cam shaft 70. The exhaust cam shaft inner oil passage 80 is made to communicate with the bolt accommodating hole 22*a* of the cylinder head 22, and hence worn-out powder and the like contained in oil supplied in a direction toward the bolt accommodating hole 22*a* in the cylinder head 22 can be retained in the bolt accommodating hole 22*a* in the cylinder head 22. Accordingly, it is possible to supply oil from which impurities are removed to the valve train.

Further, the flange portion 88 for restricting an axial thrust is formed on the exhaust cam shaft 70, and the exhaust cam shaft oil supply passage 81 leading to the inside of the exhaust cam shaft 70 is disposed adjacent to the flange portion 88. Therefore, bubbles generated around the flange portion 88 can be readily discharged through the exhaust cam shaft oil supply passage 81 whereby lubrication performance of the flange portion can be improved.

Although the embodiment of the present invention has been described in detail, the present invention is not limited to the above-described embodiment, and various modifications are conceivable. Further, the internal combustion engine of the present invention is applicable not only to the motorcycle shown but is widely applicable to other kinds of saddle riding vehicles.

DESCRIPTION OF REFERENCE SIGNS

E: internal combustion engine
L: cylinder axis
Lc: axis
C: axis
20: crankcase
21: cylinder body
21*b*: bolt insertion hole
22: cylinder head
22*a*: bolt accommodating hole
22*b*: bolt insertion hole
22*h*: tensioner lifter mounting surface
23: cylinder head cover
30: crankshaft
36: oil pump
37: oil lifter
56: cam chain
60: intake cam shaft
63: first intake cam
64: second intake cam
70: exhaust cam shaft
70*a*: right end portion
70*b*: left end portion
71: first bearing journal portion
72: second bearing journal portion
73: first exhaust cam
74: second exhaust cam
76: decompression shaft hole
78: decompression weight swing restricting portion
79: decompression shaft removal preventing threaded portion
80: exhaust cam shaft inner oil passage
90: decompression device
91: decompression shaft
91*a*: decompression weight
92: decompression pin
100: valve train oil supply passage
102*b*: branching portion
102*c*: tensioner lifter oil supply passage
102*d*: valve train side oil passage
103: center oil passage
104: journal portion communicating oil passage
110: cam chain tensioner device
111: cam chain tensioner
113: tensioner lifter
120: bolt

The invention claimed is:

1. An internal combustion engine of a saddle riding vehicle, wherein the engine has a valve train in which an exhaust camshaft rotatably mounted on a cylinder head forms a portion of an oil supply passage to the valve train, the exhaust camshaft having a bearing journal portion on one side thereof and another bearing journal portion on another side, and the valve train includes a centrifugal decompression device making use of rotation of the exhaust camshaft, wherein:

the valve train includes one bearing journal portion formed on one end of the exhaust camshaft and supported by the cylinder head, and another bearing journal portion on another end of the camshaft;

an input sprocket mounting portion for mounting thereon an input sprocket for driving the camshaft is formed on the one end of the camshaft, while a valve operating cam portion is formed on the other end of the camshaft;

a decompression shaft hole receiving rotatably therein a decompression shaft of the decompression device is formed in the camshaft from the input sprocket mounting portion toward the valve operating cam portion;

the decompression shaft hole is formed at a position offset from an axis of the camshaft;

a camshaft inner oil passage is formed in the camshaft to supply a lubricant to the bearing journal portion on the one side and to the bearing journal portion on the other side, the camshaft inner oil passage extending from the one end to the other end of the camshaft in parallel arrangement to the decompression shaft hole;

a decompression weight swing restricting portion for restricting rotation of a decompression weight integrally provided on the decompression shaft is disposed on one end of the camshaft at a position offset from the axis of the camshaft; and a decompression shaft removal preventing threaded portion is formed in the decompression weight swing restricting portion at a position parallel to the decompression shaft hole and offset from the axis of the camshaft, the decompression shaft removal preventing threaded portion being threadedly engaged with a bolt for preventing removal of the decompression shaft.

2. The internal combustion engine of a saddle riding vehicle according to claim 1, wherein:

the camshaft has a first exhaust cam between the bearing journal portion on the one side and the bearing journal portion on the other side, and a second exhaust cam axially outside the bearing journal portion on the other side;

the decompression device includes a decompression pin for movements to project from and retract into the second exhaust cam on the camshaft in connection with rotation of the decompression shaft;

the decompression shaft hole extends axially to an area between the bearing journal portion on the one side and the bearing journal portion on the other side; and the camshaft inner oil passage is arranged on a side opposite to the decompression shaft removal preventing threaded portion with respect to the decompression pin, as viewed along the axis of the camshaft.

3. The internal combustion engine of a saddle riding vehicle according to claim 2, wherein:

the bearing journal portion on the one side has a diameter greater than a diameter of the bearing journal portion on the other side; and the decompression shaft removal preventing threaded portion is formed as a hole axially extending in the region of the bearing journal portion on the one side.

4. The internal combustion engine of a saddle riding vehicle according to claim 3, wherein a center hole portion is formed in the decompression weight swing restricting portion of the camshaft, the center hole portion being a reference portion in machining the camshaft.

5. The internal combustion engine of a saddle riding vehicle according to claim 4, wherein:

a tightening member accommodating hole is formed in a surface of the cylinder head, facing a cylinder head cover, the tightening member accommodating hole being for insertion and accommodation of a tightening member for fastening a crankcase and a cylinder body of the engine to each other;

the bearing journal portion on the one side is rotatably supported by a head-side journal receiving portion disposed above the tightening member accommodating hole of the cylinder head and by a holder-side journal receiving portion formed on a camshaft holder-positioned above the camshaft; and the camshaft inner oil passage is in communication with the tightening member accommodating hole of the cylinder head.

6. The internal combustion engine of a saddle riding vehicle according to claim 5, wherein:

the camshaft has thereon a flange portion for restricting an axial thrust; and an oil passage leading into the camshaft is provided adjacent to the flange portion.

* * * * *